US010815035B2

(12) United States Patent
Torrison et al.

(10) Patent No.: US 10,815,035 B2
(45) Date of Patent: Oct. 27, 2020

(54) SYSTEM AND METHOD FOR IMPLEMENTING CAP CLOSURE FOR CARBONATED AND OXYGEN SENSITIVE BEVERAGES

(71) Applicant: G3 Enterprises, Inc., Modesto, CA (US)

(72) Inventors: Miriam Torrison, Modesto, CA (US); John Cunningham, Tracy, CA (US); Scott DeJong, Ripon, CA (US)

(73) Assignee: G3 Enterprises, Inc., Modesto, CA (US)

( * ) Notice: Subject to any disclaimer, the term of this patent is extended or adjusted under 35 U.S.C. 154(b) by 0 days.

(21) Appl. No.: 14/608,016

(22) Filed: Jan. 28, 2015

(65) Prior Publication Data

US 2015/0210440 A1 Jul. 30, 2015

Related U.S. Application Data

(60) Provisional application No. 61/932,701, filed on Jan. 28, 2014.

(51) Int. Cl.
*B65D 41/14* (2006.01)

(52) U.S. Cl.
CPC ..... *B65D 41/145* (2013.01)

(58) Field of Classification Search
CPC ..... B65D 41/045
USPC ..... 215/341, 349
See application file for complete search history.

(56) References Cited

U.S. PATENT DOCUMENTS

| | | | | |
|---|---|---|---|---|
| 4,462,502 | A | 7/1984 | Luenser et al. | |
| 5,673,809 | A * | 10/1997 | Ohmi | B65D 41/045 215/252 |
| 5,829,608 | A * | 11/1998 | Clerget | B65D 41/28 215/277 |
| 6,082,566 | A | 7/2000 | Yousif et al. | |
| 6,139,931 | A | 10/2000 | Finkelstein et al. | |
| 6,866,926 | B1 | 3/2005 | Smelko et al. | |
| 6,902,075 | B2 | 6/2005 | O'Brien et al. | |
| 7,798,359 | B1 | 9/2010 | Marsella | |
| 8,703,265 | B2 | 4/2014 | Thorstensen-Woll et al. | |
| 2002/0012808 | A1 | 1/2002 | Ishizaki et al. | |
| 2002/0162818 | A1* | 11/2002 | Williams | 215/343 |
| 2004/0191445 | A1* | 9/2004 | Baranowski et al. | 428/35.7 |

(Continued)

FOREIGN PATENT DOCUMENTS

| | | | |
|---|---|---|---|
| CN | 101891031 | A | 11/2010 |
| FR | 1226696 | A | 7/1960 |

(Continued)

OTHER PUBLICATIONS

FR 1.249.847 English translation.*

(Continued)

*Primary Examiner* — Jeffrey R Allen
(74) *Attorney, Agent, or Firm* — Goodwin Procter LLP

(57) ABSTRACT

A system and method for implementing cap closure for a carbonated beverage is disclosed. According to one embodiment, an apparatus includes a cap liner having a circular ring shape. The apparatus further comprises an outer lip and an inner portion of the circular ring shape. The outer lip is taller than the inner portion, and the outer lip has two or more structures extending away from a center of the outer lip.

18 Claims, 40 Drawing Sheets

(56) References Cited

U.S. PATENT DOCUMENTS

| | | | |
|---|---|---|---|
| 2007/0007229 | A1 | 1/2007 | Yousif |
| 2009/0026166 | A1 | 1/2009 | Druitt |
| 2009/0123766 | A1 | 5/2009 | Peck |
| 2009/0208729 | A1 | 8/2009 | Allegaert et al. |
| 2010/0213193 | A1 | 8/2010 | Helmlinger et al. |
| 2012/0067842 | A1 | 3/2012 | Keller |
| 2012/0111758 | A1 | 5/2012 | Lo |
| 2012/0118764 | A1 | 5/2012 | Valus et al. |
| 2013/0161282 | A1 | 6/2013 | Peck |

FOREIGN PATENT DOCUMENTS

| | | | |
|---|---|---|---|
| FR | 1249847 | A | 1/1961 |
| FR | 1279992 | A | 12/1961 |
| FR | 2821064 | A1 | 8/2002 |
| GB | 675236 | A | 7/1952 |
| WO | WO-2004070410 | A1 | 8/2004 |
| WO | WO-2006113000 | A2 | 10/2006 |
| WO | WO-2006113000 | A3 | 10/2006 |

OTHER PUBLICATIONS

International Search Report dated May 11, 2015 in corresponding PCT Application No. PCT/US2015/013346 filed Jan. 28, 2015, inventor(s) Torrison, Miriam, et al.

"GPI-1680 Roll-On Finish Compatible With Stel Capsules Technical Bulletin", Glass Packaging Institute, www.gpi.org, Jun. 15, 2005.

Supplementary European Search report dated Aug. 25, 2017 in corresponding EP Application No. EP15744075, filed Jul. 27, 2016, Inventor(s) Torrison, Miriam, et al.

International Search Report dated Feb. 22, 2013 in corresponding PCT Application No. PCT/US2012/71444 filed Dec. 21, 2012, inventor, Peck, James.

Evergreen, The barrier performance of common plastic film, www.evergreen-packaging.com.

Buntinx,Mieke, et al., Evaluation of the Thickness and Oxygen Transmission Rate Before and After Thermoforming Mono-and Multi-layer Sheets into Trays with Variable Depth; Polymers ISSN 2073-4360; www,mdpi.com/journal/polymers.

* cited by examiner

1004

| Trial # | Lip Structure Angle (degrees) | Lip Structure Thickness (in) | Lip Diameter from Baseline (in) |
|---|---|---|---|
| 1 | 0 | 0.012 | -0.01 |
| 2 | 0 | 0.016 | 0 |
| 3 | 140 | 0.008 | 0 |
| 4 | 70 | 0.012 | 0 |
| 5 | 35 | 0.008 | -0.02 |
| 6 | 105 | 0.016 | -0.01 |
| 7 | 140 | 0.012 | -0.02 |

OXYLON® 420 VP 1176452 white PFT

PHYSICAL AND CHEMICAL PROPERTIES

| | | |
|---|---|---|
| Form | : | granular |
| Colour | : | white |
| Odour | : | slight |
| pH | : | not applicable |
| Melting Point | : | not determined |
| Flash point | : | > 100℃<br>at 1.013 hPa<br>Method:<br>not determined |
| Vapour pressure | : | no data available |
| Density | : | ca. 0,9 g/cm$^3$<br>at 20 ℃<br>(1.013 hPa) |
| Bulk density | : | ca. 0,5 kg/m$^3$<br>at 1.013 hPa |
| Water solubility | : | negligible |
| Viscosity, kinematic | : | not applicable |
| Viscosity, dynamic | : | not applicable |
| Surface tension | : | not determined |
| Auto-flammability | : | not auto-flammable |
| Partition coefficient: n-octanol/water | : | no data available |

FIG. 35

Preliminary Technical Datasheet

Oxylon® 420 VP 1176452 white PFT

| | |
|---|---|
| *Material:* | TPE - granulate, development product |
| *Intended use:* | TPE - sealing compound for aluminium closures |
| *Physical properties:* | |
| Shore Hardness A (ASTM D 2240-97, 5 mm) | 94 |
| Shore Hardness D (ASTM D 2240-97, 5 mm) | 37 |
| Melt flow index (ISO 1133:1997, 5,00kg, 190°C) | 31 |
| *Colour:* | white |
| *Regulatory Information:* | The raw materials comply with the FDA and / or BfR or EU recommendations or regulations. |
| *Storage conditions:* | Store away from direct sunlight, heat of more than 40°C (100°F), humidity and odours. |
| *Please note:* | The information provided herein is valid until three months after issue. |

FIG. 36

OXYLON® 907 VP 1176454 white

PHYSICAL AND CHEMICAL PROPERTIES

| | | |
|---|---|---|
| Form | : | granular |
| Colour | : | white |
| Odour | : | slight |
| pH | : | not applicable |
| Melting Point | : | not determined |
| Flash point | : | > 100°C<br>at 1.013 hPa<br>Method:<br>not determined |
| Vapour pressure | : | no data available |
| Density | : | ca. 0,9 g/cm$^3$<br>at 20 °C<br>(1.013 hPa) |
| Bulk density | : | ca. 0,5 kg/m$^3$<br>at 1.013 hPa |
| Water solubility | : | negligible |
| Viscosity, kinematic | : | not applicable |
| Viscosity, dynamic | : | not applicable |
| Surface tension | : | not determined |
| Auto-flammability | : | not auto-flammable |
| Partition coefficient: n-octanol/water | : | no data available |

FIG. 37

Preliminary Technical Datasheet

Oxylon® 907 VP 130104 white

| | |
|---|---|
| *Material:* | TPE - granulate, development product |
| *Intended use:* | TPE - sealing compound for aluminium closures |

*Physical properties:*

| | |
|---|---|
| Shore Hardness A (ASTM D 2240-97, 5 mm) | 94 |
| Shore Hardness D (ASTM D 2240-97, 5 mm) | 36 |
| Melt flow index (ISO 1133:1997, 5,00kg, 190°C) | 20 |

| | |
|---|---|
| *Colour:* | white |
| *Regulatory Information:* | The raw materials comply with the FDA and / or BfR or EU recommendations or regulations. |
| *Storage conditions:* | Store away from direct sunlight, heat of more than 40°C (100°F), humidity and odours. |
| *Please note:* | The information provided herein is valid until 6 months after issue. |

FIG. 38

*OXYLON® CS 25 white*

PHYSICAL AND CHEMICAL PROPERTIES

| | | |
|---|---|---|
| Form | : | granular |
| Colour | : | white |
| Odour | : | slight |
| pH | : | not applicable |
| Melting Point | : | not determined |
| Flash point | : | > 100℃<br>at 1.013 hPa<br>Method:<br>not determined |
| Vapour pressure | : | no data available |
| Density | : | ca. 0,9 g/cm$^3$<br>at 20 ℃<br>(1.013 hPa) |
| Bulk density | : | ca. 0,5 kg/m$^3$<br>at 1.013 hPa |
| Water solubility | : | negligible |
| Viscosity, kinematic | : | not applicable |
| Viscosity, dynamic | : | not applicable |
| Surface tension | : | not determined |
| Auto-flammability | : | not auto-flammable |
| Partition coefficient: n-octanol/water | : | no data available |

FIG. 39

Preliminary Technical Datasheet

Oxylon® CS 25 VP 130105 white

| | |
|---|---|
| *Material:* | TPE - granulate, development product |
| *Intended use:* | TPE - sealing compound for aluminiumcaps |
| *Physical properties:* | |
| Shore Hardness D (ASTM D 2240-97, 5 mm) | 48 |
| Melt flow index (ISO 1133:1997, 5,00kg, 190°C) | 18 |
| *Colour:* | white |
| *Regulatory Information:* | The raw materials comply with the FDA and / or BfR or EU recommendations or regulations. |
| *Storage conditions:* | Store away from direct sunlight, heat of more than 40°C (100°F), humidity and odours. |
| *Please note:* | The information provided herein is valid until three months after issue. |

FIG. 40

SYSTEM AND METHOD FOR IMPLEMENTING CAP CLOSURE FOR CARBONATED AND OXYGEN SENSITIVE BEVERAGES

CROSS-REFERENCE TO RELATED APPLICATIONS

The present application claims priority to U.S. Provisional Patent Application No. 61/932,701, filed on Jan. 28, 2014, entitled "System and Method for Implementing Cap Closure for Carbonated Wine", which is herein incorporated by reference.

FIELD

The present disclosure relates in general to cap closures. In particular, the present disclosure relates to a system and method for implementing cap closure for carbonated and oxygen sensitive beverages such as wine.

BACKGROUND

A number of wineries offer lower alcohol (e.g. 9%), lightly sweet, semi-sparkling wines. These semi-sparkling wines are marketed and promoted to consumers as casual and approachable wines that are ideal for outdoor get-togethers with family and friends. Semi-sparkling wine contains a significant level of carbon dioxide that gives its fizzy appearance and effervescent mouth feel. The pressure in a bottle of semi-sparkling wine typically varies from approximately 0.3 to 2 atmospheres which equates to concentrations of 2 to 5 g $CO_2$/L at 20° C.

There are five main issues when applying traditional wine closures for these semi-sparkling wines: brand image, ease of opening, re-sealability, oxygen ingress control and pressure retention. Champagne corks with wire hoods are too formal. Crown closures have a more relaxed image, but are not easy to open. Additionally, both champagne corks and crown closures are not designed to be easily reapplied to the package by the consumer. Long-skirt screw-caps (e.g. 30 mm diameter×60 mm tall aluminum closures with traditional SARANEX™ liners) provide the right marketing image and are easy to re-apply. However, lab tests show that these long-skirt screw-caps containing SARANEX liners cannot consistently retain an internal pressure greater than 40 psi within a bottle of semi-sparkling wine. Such internal pressures in these semi-sparkling wines can be reached under typical shipping and storage conditions.

There are several injection molded liner technologies commercially available for carbonated wine such as GUALA® MOSS and ERBEN® ASTRO. These liners are specifically designed for carbonated products and are typically used in 30×60 aluminum screw-caps. These liners are made of a low-density polyethylene material resulting in relatively low material costs but comparatively high oxygen transmission rates (OTR) of 0.003 cc $O_2$/closure/24 hours.

SUMMARY

A system and method for implementing cap closure for a carbonated beverage is disclosed. According to one embodiment, an apparatus includes a cap liner having a circular ring shape. The apparatus further comprises an outer lip and an inner portion of the circular ring shape. The outer lip is taller than the inner portion, and the outer lip has two or more structures extending away from a center of the outer lip.

The above and other preferred features, including various novel details of implementation and combination of elements, will now be more particularly described with reference to the accompanying figures and pointed out in the claims. It will be understood that the particular systems and methods described herein are shown by way of illustration only and not as limitations. As will be understood by those skilled in the art, the principles and features described herein may be employed in various and numerous embodiments.

BRIEF DESCRIPTION OF THE FIGURES

The accompanying figures, which are included as part of the present specification, illustrate the various embodiments of the present disclosed system and method and together with the general description given above and the detailed description of the preferred embodiments given below serve to explain and the teach the principles of the present disclosure.

FIG. 1(*b*) illustrates a cross-sectional view of an exemplary cap liner as illustrated in FIG. 1(*a*), according to one embodiment.

FIG. 1(*c*) illustrates a detailed cross-sectional view of an exemplary cap liner as illustrated in FIG. 1(*b*), according to one embodiment.

FIG. 2(*b*) illustrates a cross-sectional view of another exemplary cap liner as illustrated in FIG. 2(*a*), according to one embodiment.

FIG. 2(*c*) illustrates a detailed cross-sectional view of another exemplary cap liner as illustrated in FIG. 2(*b*), according to one embodiment.

FIG. 3(*b*) illustrates a cross-sectional view of another exemplary cap liner as illustrated in FIG. 3(*a*), according to one embodiment.

FIG. 3(*c*) illustrates a detailed cross-sectional view of another exemplary cap liner as illustrated in FIG. 3(*b*), according to one embodiment.

FIG. 4(*b*) illustrates a cross-sectional view of another cap liner as illustrated in FIG. 4(*a*), according to one embodiment.

FIG. 4(*c*) illustrates a detailed cross-sectional view of another exemplary cap liner as illustrated in FIG. 4(*b*), according to one embodiment.

FIG. 5(*b*) illustrates a cross-sectional view of another exemplary cap liner as illustrated in FIG. 5(*a*), according to one embodiment.

FIG. 5(*c*) illustrates a detailed cross-sectional view of another exemplary cap liner as illustrated in FIG. 5(*b*), according to one embodiment.

FIG. 6(*b*) illustrates a cross-sectional view of another cap liner as illustrated in FIG. 6(*a*), according to one embodiment.

FIG. 6(*c*) illustrates a detailed cross-sectional view of another exemplary cap liner as illustrated in FIG. 6(*b*), according to one embodiment.

FIG. 7(*b*) illustrates a cross-sectional view of another exemplary cap liner as illustrated in FIG. 7(*a*), according to one embodiment.

FIG. 7(*c*) illustrates a detailed cross-sectional view of another exemplary cap liner as illustrated in FIG. 7(*b*), according to one embodiment.

FIG. 8(*b*) illustrates a cross-sectional view of another exemplary cap liner as illustrated in FIG. 8(*a*), according to one embodiment.

FIG. 8(*c*) illustrates a detailed cross-sectional view of another exemplary cap liner as illustrated in FIG. 8(*b*), according to one embodiment.

FIG. 9(*b*) illustrates a detailed cross-sectional view of another exemplary cap liner in a screw cap as illustrated in FIG. 9(*a*), according to one embodiment.

FIG. 9(*c*) illustrates a top view of another exemplary cap liner as illustrated in FIG. 9(*a*), according to one embodiment.

FIG. 9(*d*) illustrates a cross-sectional view of another exemplary cap liner as illustrated in FIG. 9(*c*), according to one embodiment.

FIG. 9(*e*) illustrates a detailed cross-sectional view of another exemplary cap liner as illustrated in FIG. 9(*d*), according to one embodiment.

FIG. 10(*b*) illustrates the effect of various liner outer lip structural elements on the liner performance characteristics, according to one embodiment.

FIG. 11(*b*) illustrates a cross-sectional view of another exemplary cap liner as illustrated in FIG. 11(*a*), according to one embodiment.

FIG. 11(*c*) illustrates a detailed cross-sectional view of another exemplary cap liner as illustrated in FIG. 11(*b*), according to one embodiment.

FIG. 12(*b*) illustrates a cross-sectional view of another exemplary cap liner as illustrated in FIG. 12(*a*), according to one embodiment.

FIG. 12(*c*) illustrates a detailed cross-sectional view of another exemplary cap liner as illustrated in FIG. 12(*b*), according to one embodiment.

FIG. 13(*b*) illustrates a cross-sectional view of another exemplary cap liner as illustrated in FIG. 13(*a*), according to one embodiment.

FIG. 13(*c*) illustrates a detailed cross-sectional view of another exemplary cap liner as illustrated in FIG. 13(*b*), according to one embodiment.

FIG. 14(*b*) illustrates a cross-sectional view of another exemplary cap liner as illustrated in FIG. 14(*a*), according to one embodiment.

FIG. 14(*c*) illustrates a detailed cross-sectional view of another exemplary cap liner as illustrated in FIG. 14(*b*), according to one embodiment.

FIG. 15(*b*) illustrates a cross-sectional view of another exemplary cap liner as illustrated in FIG. 15(*a*) according to one embodiment.

FIG. 15(*c*) illustrates a detailed cross-sectional view of another exemplary cap liner as illustrated in FIG. 15(*b*), according to one embodiment.

FIG. 16(*b*) illustrates a cross-sectional view of another exemplary cap liner as illustrated in FIG. 16(*a*), according to one embodiment.

FIG. 16(*c*) illustrates a detailed cross-sectional view of another exemplary cap liner as illustrated in FIG. 16(*b*), according to one embodiment.

FIG. 17(*b*) illustrates a cross-sectional view of another exemplary cap liner as illustrated in FIG. 17(*a*), according to one embodiment.

FIG. 17(*c*) illustrates a detailed cross-sectional view of another exemplary cap liner as illustrated in FIG. 17(*b*), according to one embodiment.

FIG. 18(*b*) illustrates a cross-sectional view of another exemplary cap liner as illustrated in FIG. 18(*a*), according to one embodiment.

FIG. 18(*c*) illustrates a detailed cross-sectional view of another exemplary cap liner as illustrated in FIG. 18(*b*), according to one embodiment.

FIG. 19(*b*) illustrates a cross-sectional view of another exemplary cap liner as illustrated in FIG. 19(*a*), according to one embodiment.

FIG. 19(*c*) illustrates a detailed cross-sectional view of another exemplary cap liner as illustrated in FIG. 19(*b*), according to one embodiment.

FIG. 20(*b*) illustrates a detailed cross-sectional view of another exemplary cap liner in a screw cap as illustrated in FIG. 20(*a*), according to one embodiment.

FIG. 20(*c*) illustrates a top view of another exemplary cap liner according to one embodiment.

FIG. 20(*d*) illustrates a 3-dimensional view of another exemplary cap liner as illustrated in FIG. 20(*c*), according to one embodiment.

FIG. 20(*e*) illustrates a cross-sectional view of another exemplary cap liner as illustrated in FIG. 20(*c*), according to one embodiment.

FIG. 20(*f*) illustrates a detailed cross-sectional view of another exemplary cap liner as illustrated in FIG. 20(*e*), according to one embodiment.

FIGS. 35-36 illustrate exemplary physical and chemical properties of OXYLON® 420 liner material, according to one embodiment.

FIGS. 37-38 illustrate exemplary physical and chemical properties of OXYLON® 907 liner material, according to one embodiment.

FIGS. 39-40 illustrate exemplary physical and chemical properties of OXYLON® CS25 liner material, according to one embodiment.

DETAILED DESCRIPTION

Figure 1A:
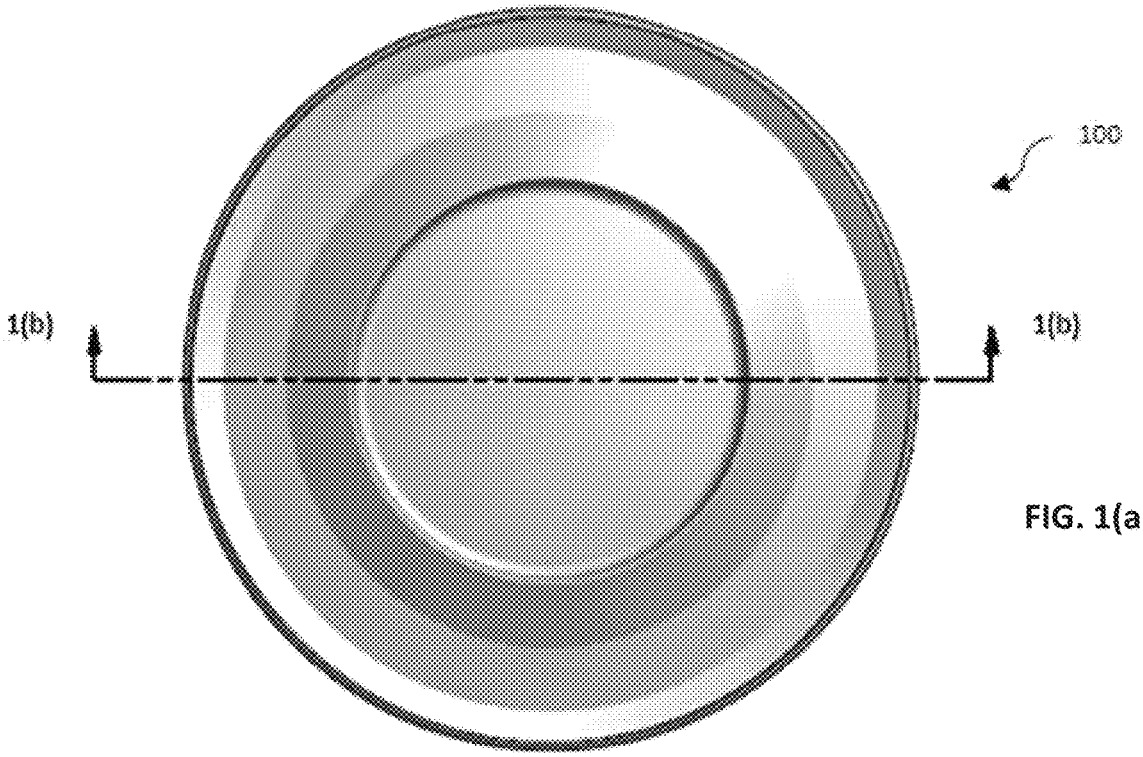
FIG. 1(*a*) illustrates a top view of an exemplary cap liner, according to one embodiment.

A system and method for implementing cap closure for a carbonated beverage is disclosed. According to one embodiment, an apparatus includes a cap liner having a circular ring shape. The apparatus further comprises an outer lip and an inner portion of the circular ring shape. The outer lip is taller than the inner portion, and the outer lip has two or more structures extending away from a center of the outer lip.

Each of the features and teachings disclosed herein can be utilized separately or in conjunction with other features and teachings to provide a system and method for implementing cap closure for carbonated and oxygen sensitive wine. Representative examples utilizing many of these additional features and teachings, both separately and in combination, are described in further detail with reference to the attached figures. This detailed description is merely intended to teach a person of skill in the art further details for practicing preferred aspects of the present teachings and is not intended to limit the scope of the claims. Therefore, combinations of features disclosed in the detailed description may not be necessary to practice the teachings in the broadest sense, and are instead taught merely to describe particularly representative examples of the present teachings.

In the description below, for purposes of explanation only, specific nomenclature is set forth to provide a thorough understanding of the present disclosure. However, it will be apparent to one skilled in the art that these specific details are not required to practice the teachings of the present disclosure.

Moreover, the various features of the representative examples and the dependent claims may be combined in ways that are not specifically and explicitly enumerated in order to provide additional useful embodiments of the present teachings. It is also expressly noted that all value ranges or indications of groups of entities disclose every possible intermediate value or intermediate entity for the purpose of original disclosure, as well as for the purpose of restricting the claimed subject matter. It is also expressly noted that the dimensions and the shapes of the components shown in the figures are designed to help to understand how the present teachings are practiced, but not intended to limit the dimensions and the shapes shown in the examples.

According to one embodiment, the present system and method provides a cap liner configuration that is formed using injection molding for an aluminum 30 mm diameter by 60 mm tall (30×60) screw-cap closure.

The present system and method provides a cap (e.g., an aluminum screw-cap) that includes a cap liner with a specified liner profile. The present cap provides a sealing performance that is controlled largely based on its liner characteristics including the liner's components and the liner's physical profile. The present system and method provides a cap liner that seals sufficiently to prevent the beverage from leaking out of the package. The present system and method further provides a cap liner that controls the transmission of oxygen from the air outside the package into the product. The amount of oxygen allowed into the package along with the rate of oxygen transmission can have a significant impact on the beverage's nutritional content, flavor and mouth feel. Liner types have traditionally been chosen by cap manufacturers (e.g., G3) with a focus on ease of use, performance, and price. According to one embodiment, the present cap liner provides an OTR value close to that of a SARANEX™ lined cap (0.0008 cc $O_2$/24 hours) and holds an internal package pressure greater than 70 psi.

Figure 1B:
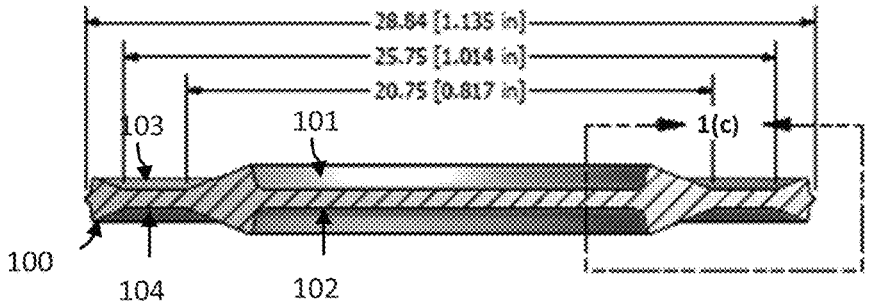
Figure 1C:
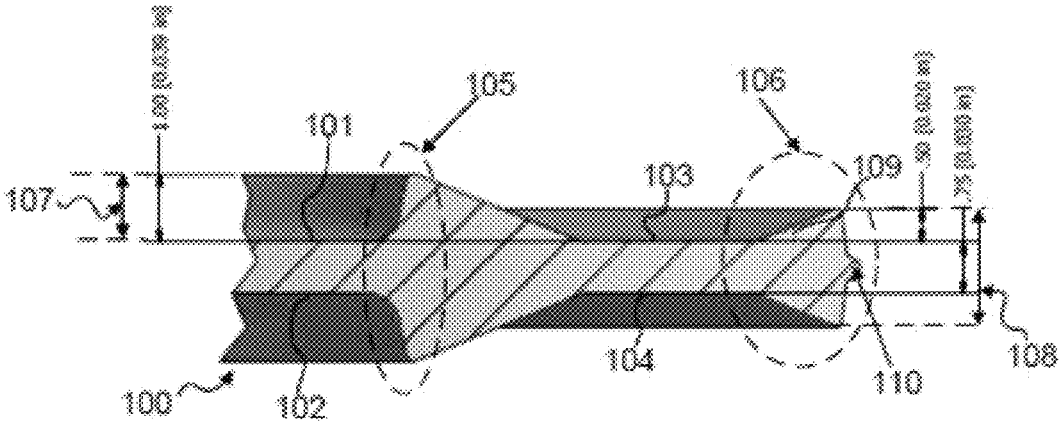

FIGS. 1(*a*)-1(*c*) illustrate respectively a top view, a cross-sectional view, and a detailed cross-sectional view of an exemplary cap liner designed for use in a 30 mm diameter aluminum top-side seal closure, according to one embodiment. The cap liner 100 is of a circular disc shape with a diameter of 28.84 millimeters (mm). The cap liner 100 includes two circular-shaped cavities 101 and 102 that are each depressed into both sides of the cap liner 100. The two circular-shaped cavities 101 and 102 create an inner ring 105 ("inner rib"), within the cap liner 100. The inner ring 105 has an inner rib height 107 of 1.00 mm created by the depression of either circular-shaped cavity 101 and 102.

The cap liner 100 further includes two ring-shaped troughs 103 and 104 that are located outside the two circular-shaped cavities 101 and 102 and inside the outer circumference of the cap liner 100. Each ring-shaped trough 103 and 104 is depressed into both sides of the cap liner 100. The base of the ring for each ring-shaped trough 103 and 104 is 5.00 mm wide. The two ring-shaped troughs 103 and 104 create an outer ring ("outer lip") 106 directly adjacent to the circumference of the cap liner 100. Each ring-shaped trough 103 and 104 is depressed at a height of 0.50 mm relative to the cap liner 100 trough's base and outer ring peak. The outer ring 106 has an overall outer lip height 108 of 1.75 mm and an outer lip angle 109 of 22° 15'. The outer ring 106 further includes an outer nub 110 designed to help retain the liner in the aluminum screw cap.

Figure 2A:
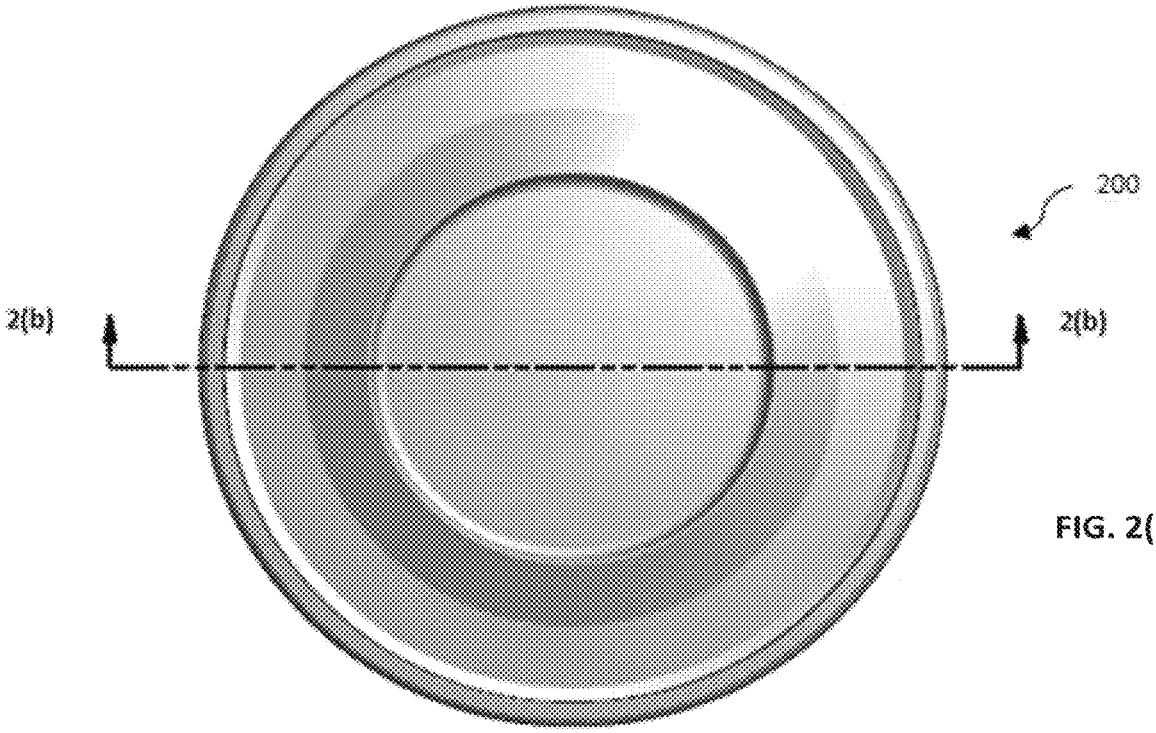
FIG. 2(*a*) illustrates a top view of another exemplary cap liner, according to one embodiment.
Figure 2B:
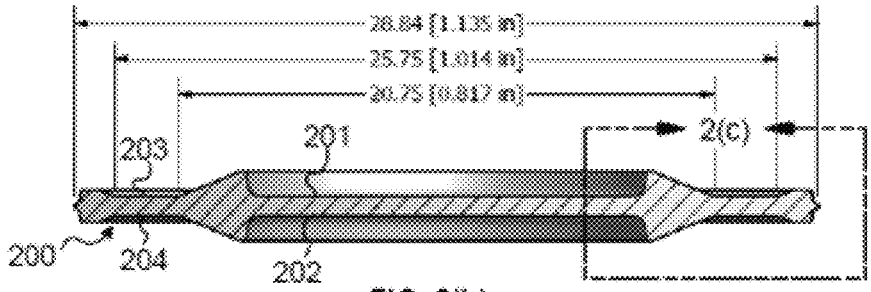
Figure 2C:
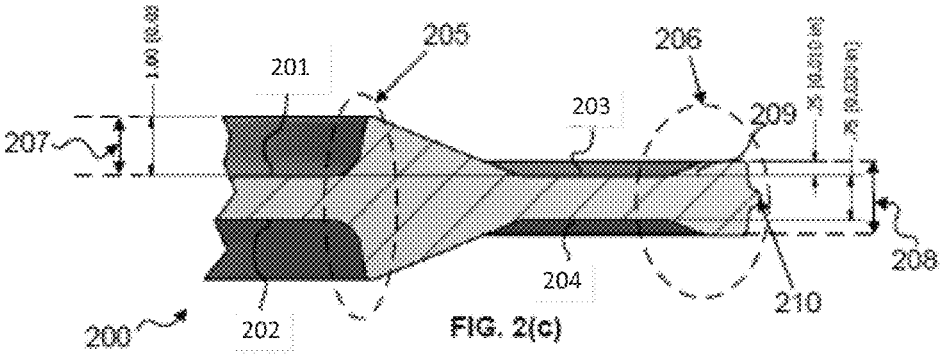

FIGS. 2(*a*)-2(*c*) illustrate respectively a top view, a cross-sectional view, and a detailed cross-sectional view of another exemplary cap liner designed for use in a 30 mm diameter aluminum top-side seal closure, according to one embodiment. The cap liner 200 is of a circular disc shape with a diameter of 28.84 mm. The cap liner 200 includes two circular-shaped cavities 201 and 202 that are each depressed into both sides of the cap liner 200. The two circular-shaped cavities 201 and 202 create an inner ring 205 ("inner rib") within the cap liner 200. The inner ring 205 has an inner rib height 207 of 1.00 mm created by the depression of either circular-shaped cavity 201 and 202.

The cap liner 200 further includes two ring-shaped troughs 203 and 204 that are located outside the two circular-shaped cavities 201 and 202 and inside the outer circumference of the cap liner 200. Each ring-shaped trough 203 and 204 is depressed into both sides of the cap liner 200. The base of the ring for each ring-shaped trough 203 and 204 is 5.00 mm wide. The two ring-shaped troughs 203 and 204 create an outer ring 206 ("outer lip") directly adjacent to the circumference of the cap liner 200. Each ring-shaped trough 203 and 204 is depressed at a height of 0.25 mm relative to the cap liner 200 trough's base and outer ring peak. The outer ring 206 has an overall outer lip height 208 of 1.25 mm and an outer lip angle 209 of 22° 15'. The outer ring 206 further includes an outer nub 210 designed to help retain the liner in the aluminum screw cap.

Figure 3A:
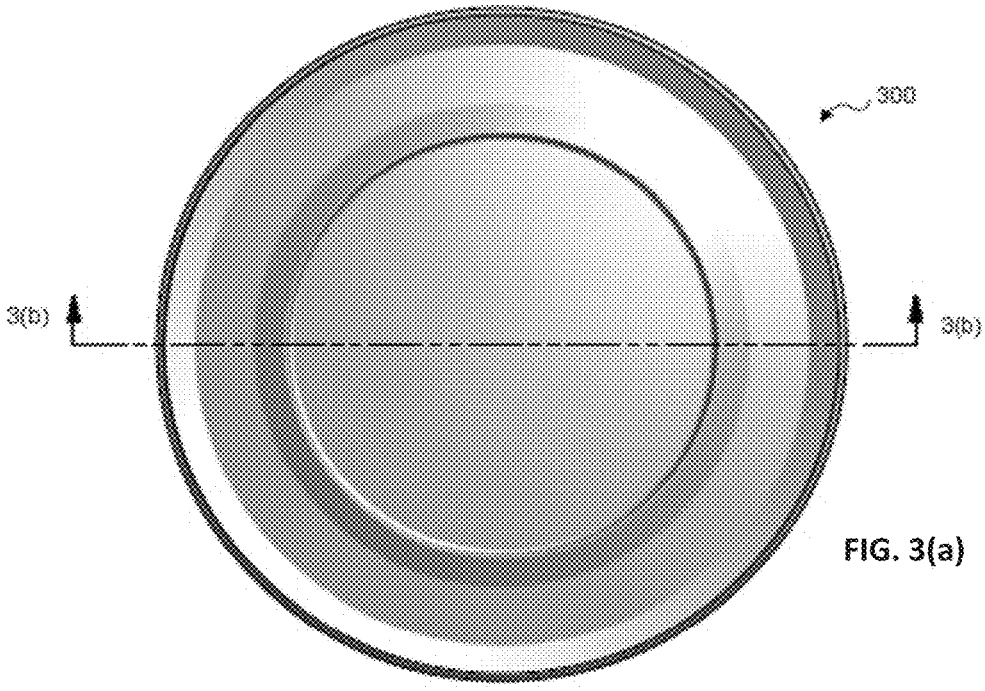
FIG. 3(*a*) illustrates a top view of another exemplary cap liner, according to one embodiment.
Figure 3B:
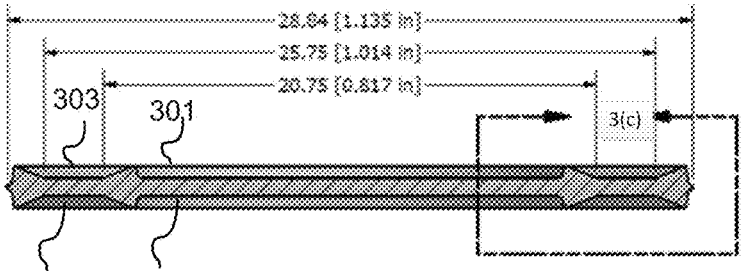
Figure 3C:
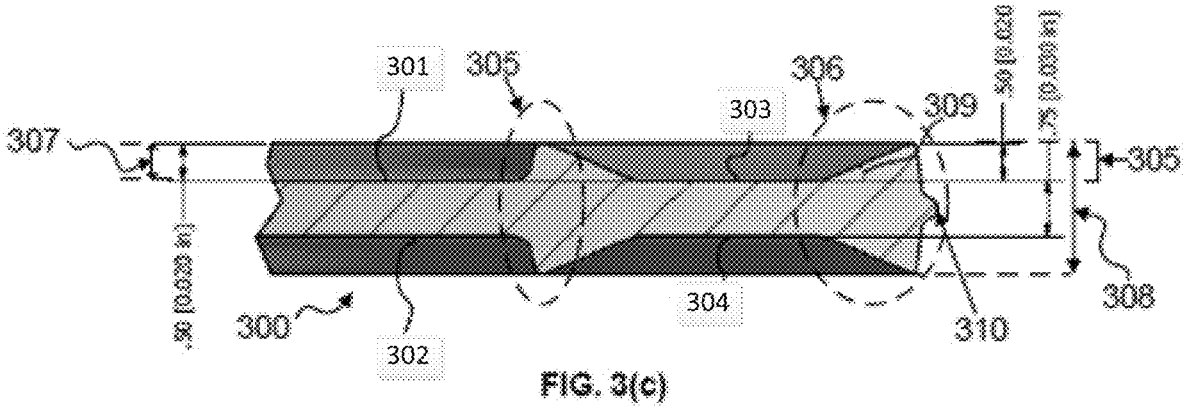

FIGS. 3(*a*)-3(*c*) illustrate respectively a top view, a cross-sectional view, and a detailed cross-sectional view of another exemplary cap liner designed for use in a 30 mm diameter aluminum top-side seal closure, according to one embodiment. The cap liner 300 is of a circular disc shape with a diameter of 28.84 mm. The cap liner 300 includes two circular-shaped cavities 301 and 302 that are each depressed into both sides of the cap liner 300. The two circular-shaped cavities 301 and 302 create an inner ring 305 ("inner rib") within the cap liner 300. The inner ring 305 has an inner rib height 307 of 0.50 mm created by the depression of either circular-shaped cavity 301 and 302.

The cap liner 300 further includes two ring-shaped troughs 303 and 304 that are located outside the two circular-shaped cavities 301 and 302 and inside the outer circumference of the cap liner 300. Each ring-shaped trough 303 and 304 is depressed into both sides of the cap liner 300. The base of the ring for each ring-shaped trough 303 and 304 is 5.00 mm wide. The two ring-shaped troughs 303 and 304 create an outer ring 306 ("outer lip") directly adjacent to the circumference of the cap liner 300. Each ring-shaped trough 303 and 304 is depressed at a height of 0.50 mm relative to the cap liner 300 trough's base and outer ring peak. The outer ring 306 has an overall outer lip height 308 of 1.75 mm and an outer lip angle 309 of 22° 15'. The outer ring 306 further includes an outer nub 310 designed to help retain the liner in the aluminum screw cap.

Figure 4A:
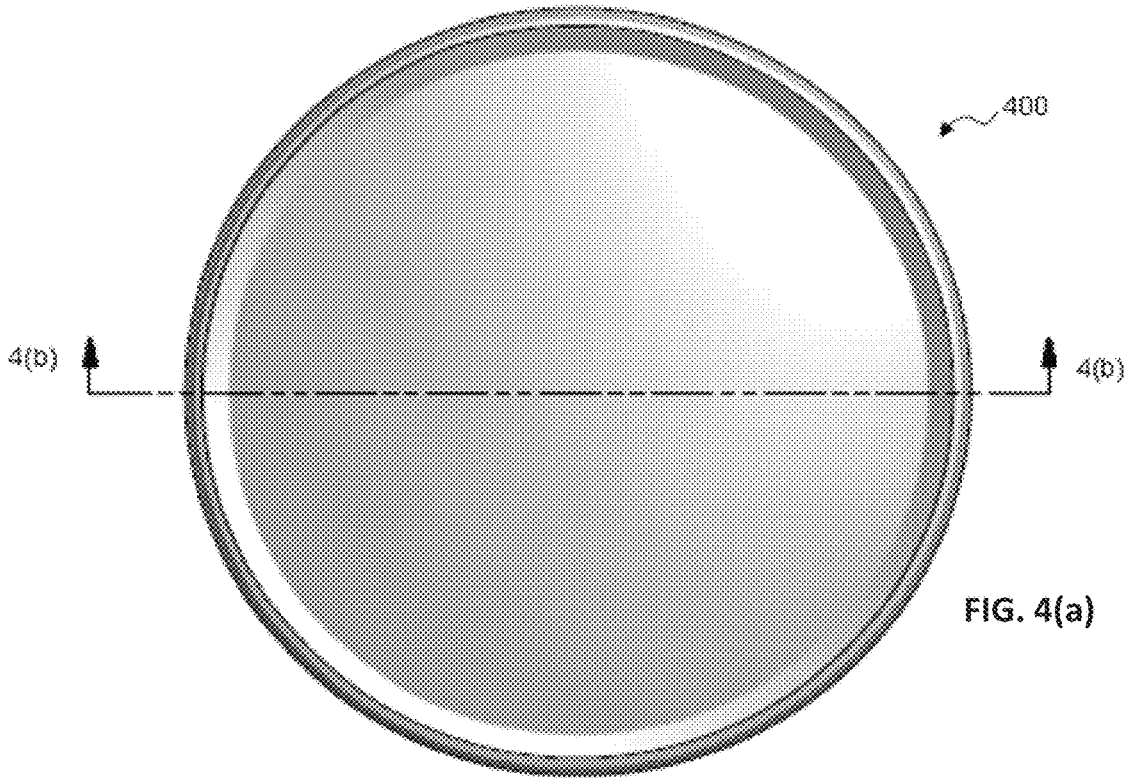
FIG. 4(*a*) illustrates a top view of another exemplary cap liner, according to one embodiment.
Figure 4B:
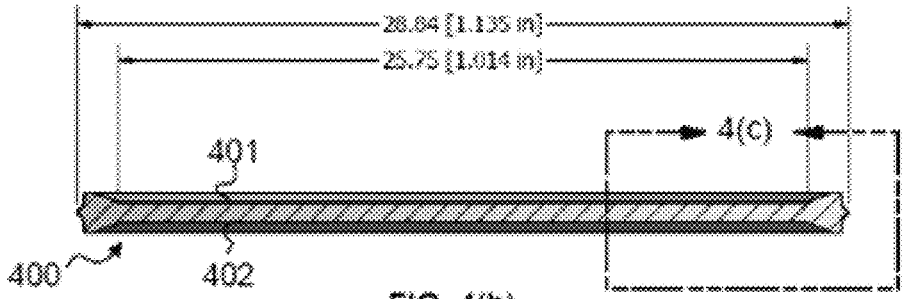
Figure 4C:
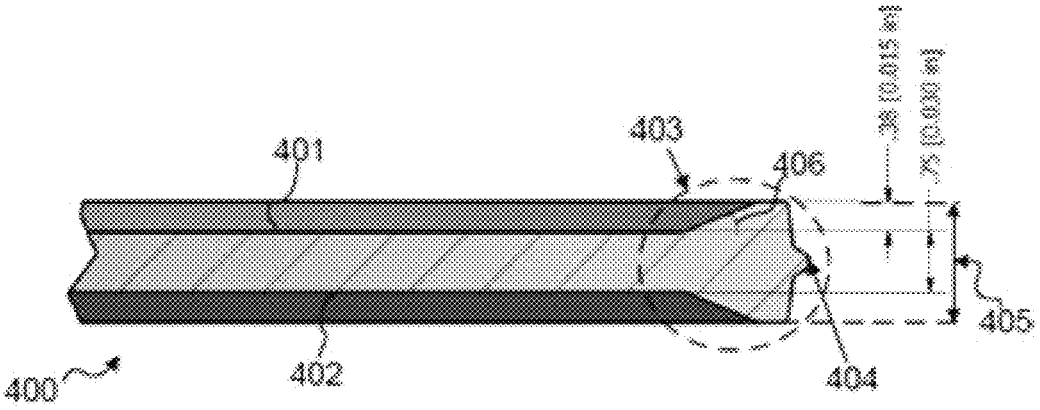

FIGS. 4(*a*)-4(*c*) illustrate respectively a top view, a cross-sectional view, and a detailed cross-sectional view of another exemplary cap liner designed for use in a 30 mm diameter aluminum top-side seal closure, according to one embodiment. The cap liner 400 is of a circular disc shape with a diameter of 28.84 mm. The cap liner 400 includes two circular-shaped cavities 401 and 402 that are each depressed into both sides of the cap liner 400. Each circular-shaped cavity 401 and 402 has a base diameter of 25.75 mm. The two circular-shaped cavities 401 and 402 create an outer ring 403 ("outer lip") directly adjacent to a circumference of the cap liner 400. The outer lip 403 has a height 405 of 1.51 mm and an outer lip angle 406 of 22° 15'. The outer ring 403 further includes an outer nub 404 designed to help retain the liner in the aluminum screw cap.

Figure 5A:
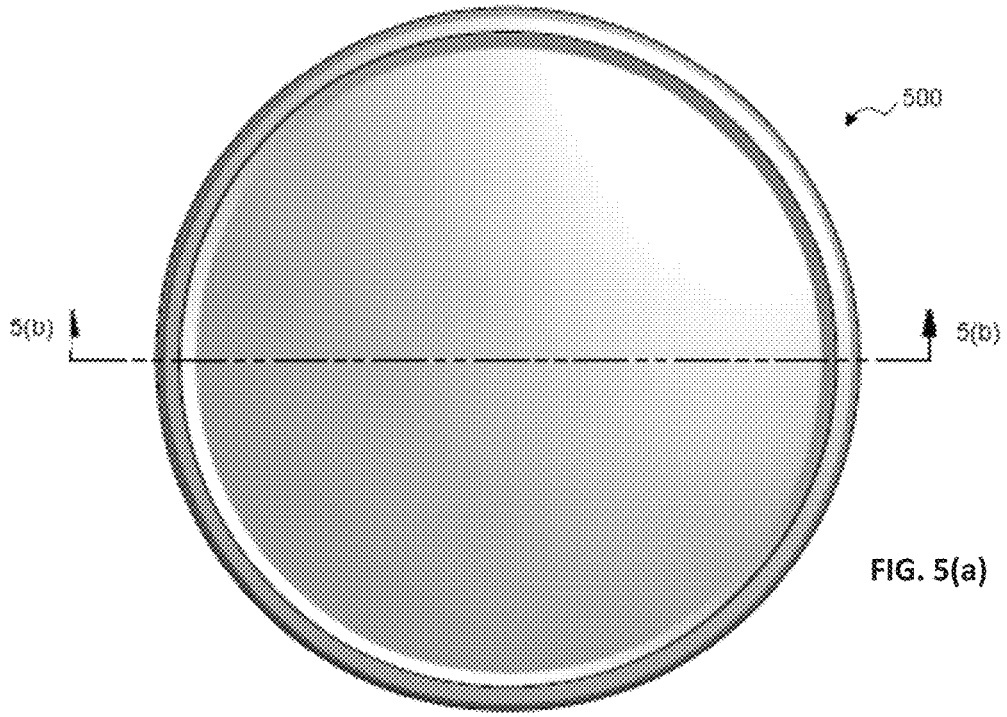
FIG. 5(*a*) illustrates a top view of another exemplary cap liner, according to one embodiment.
Figure 5B:
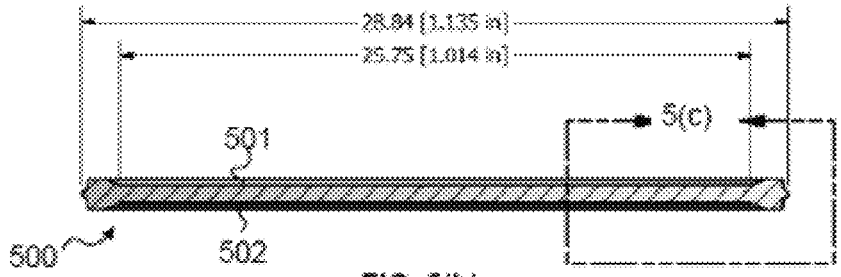
Figure 5C:
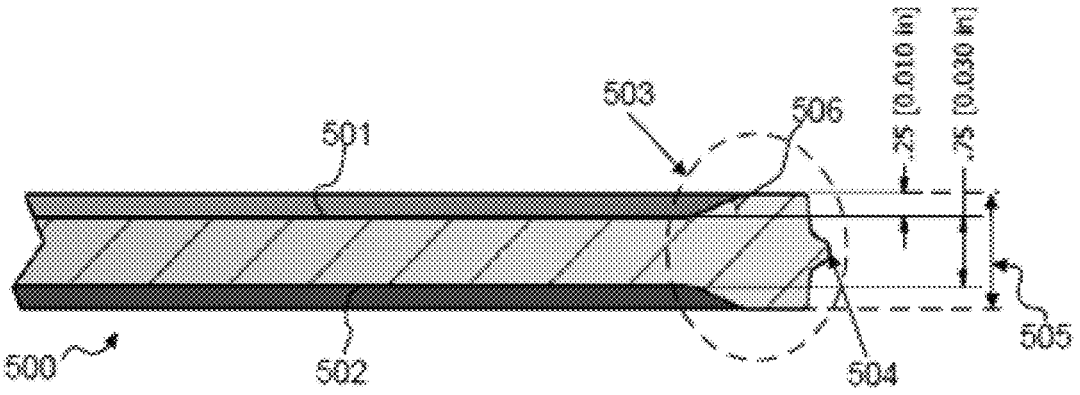

FIGS. 5(*a*)-5(*c*) illustrate respectively a top view, a cross-sectional view, and a detailed cross-sectional view of another cap liner designed for use in a 30 mm diameter aluminum top-side seal closure, according to one embodiment. The cap liner 500 is of a circular disc shape with a diameter of 28.84 mm. The cap liner 500 includes two circular-shaped cavities 501 and 502 that are each depressed into both sides of the cap liner 500. Each circular-shaped cavity 501 and 502 has a base diameter of 25.75 mm. The two circular-shaped cavities 501 and 502 create an outer ring 503 ("outer lip") directly adjacent to a circumference of the cap liner 500. The outer lip 503 has a height 505 of 1.25 mm and an outer lip angle 506 of 22° 15'. The outer ring 503 further includes an outer nub 504 designed to help retain the liner in the aluminum screw cap.

Figure 6A:
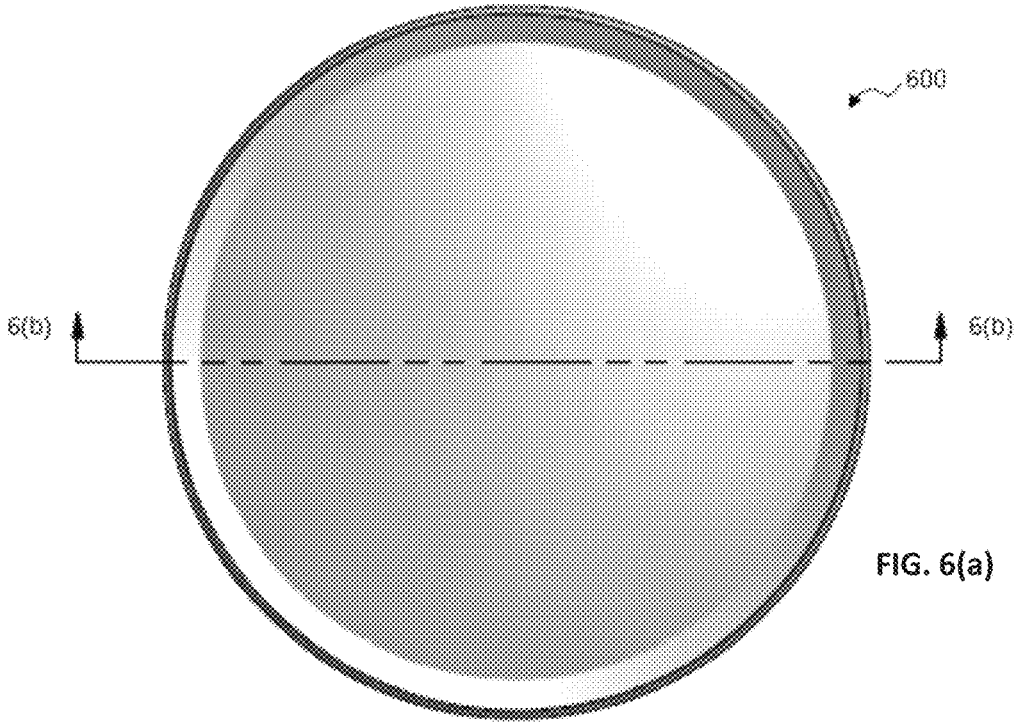
FIG. 6(*a*) illustrates a top view of another exemplary cap liner, according to one embodiment.
Figure 6B:
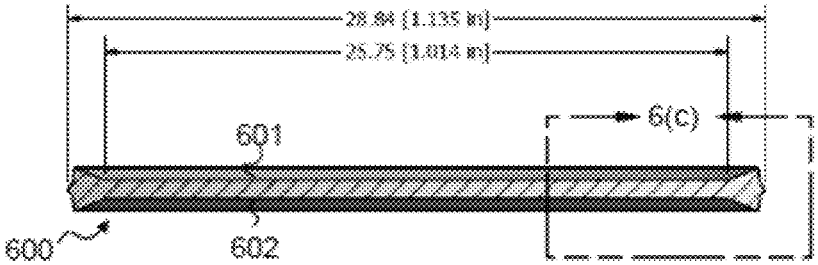
Figure 6C:
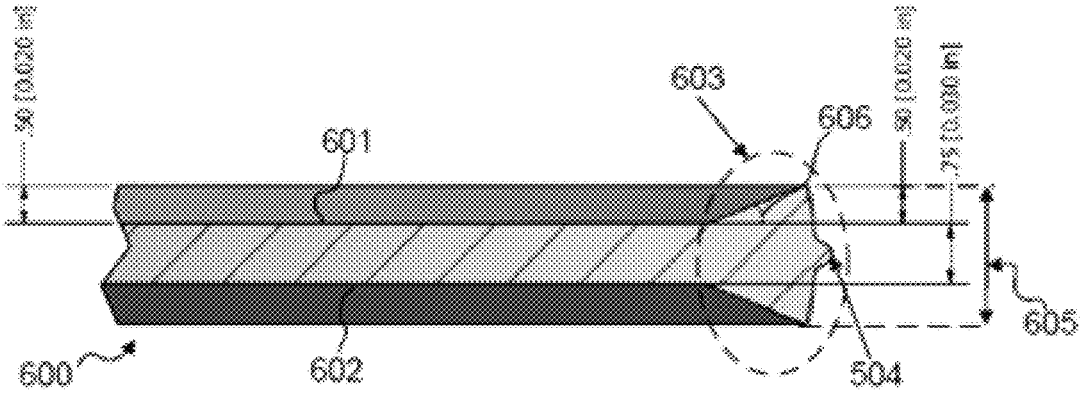

FIGS. 6(*a*)-6(*c*) illustrate respectively a top view, a cross-sectional view, and a detailed cross-sectional view of another exemplary cap liner designed for use in a 30 mm diameter aluminum top-side seal closure, according to one embodiment. The cap liner 600 is of a circular disc shape with a diameter of 28.84 mm. The cap liner 600 includes two circular-shaped cavities 601 and 602 that are each depressed into both sides of the cap liner 600. Each circular-shaped cavity 601 and 602 has a base diameter of 25.75 mm. The two circular-shaped cavities 601 and 602 create an outer ring 603 ("outer lip") directly adjacent to a circumference of the cap liner 600. The outer lip 603 has a height 605 of 1.75 mm and an outer lip angle 606 of 22° 15'. The outer ring 603 further includes an outer nub 604 designed to help retain the liner in the aluminum screw cap. The cap liner 600 has a similar liner profile to the cap liner 400 but with a modified outer lip height 605.

Figure 7A:
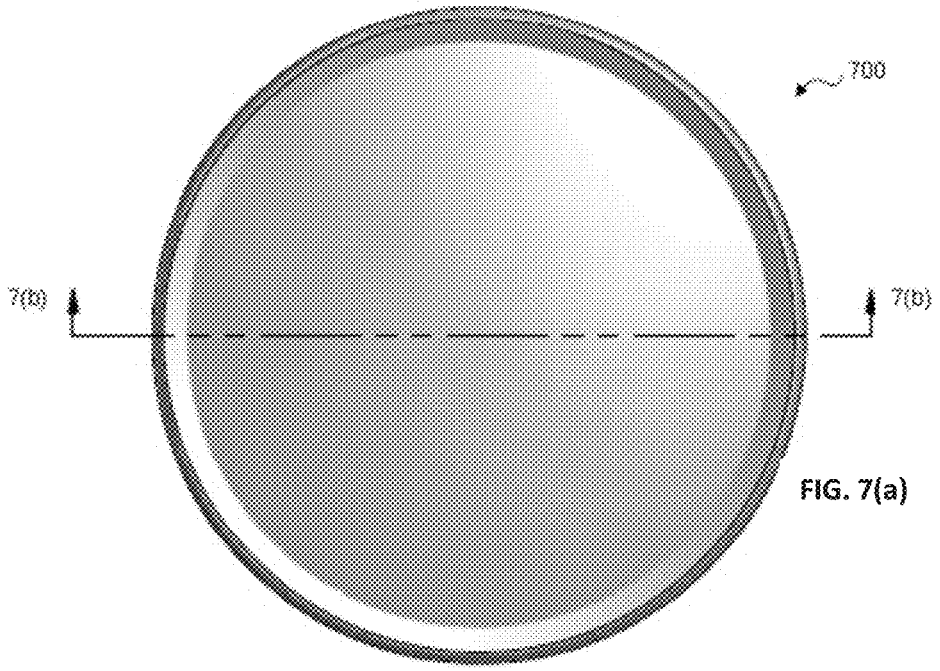
FIG. 7(*a*) illustrates a top view of another exemplary cap liner, according to one embodiment.
Figure 7B:
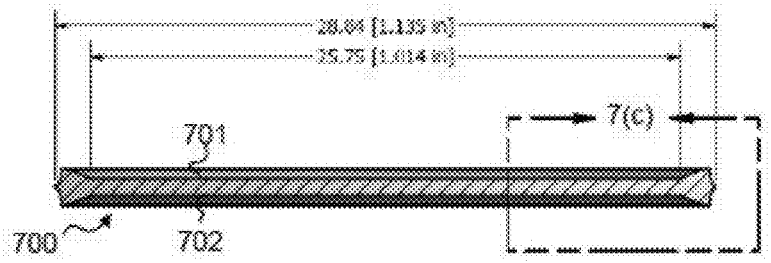
Figure 7C:
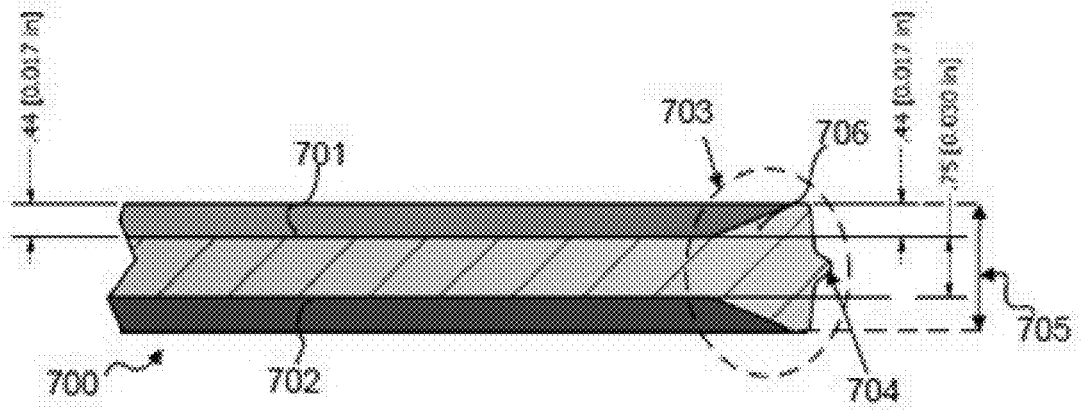

FIGS. 7(*a*)-7(*c*) illustrate respectively a top view, a cross-sectional view, and a detailed cross-sectional view of another exemplary cap liner designed for use in a 30 mm diameter aluminum top-side seal closure, according to one embodiment. The cap liner 700 is of a circular disc shape with a diameter of 28.84 mm. The cap liner 700 includes two circular-shaped cavities 701 and 702 that are each depressed into both sides of the cap liner 700. Each circular-shaped cavity 701 and 702 has a diameter of 25.75 mm. The two circular-shaped cavities 701 and 702 create an outer ring 703 ("outer lip") directly adjacent to a circumference of the cap liner 700. The outer lip 703 has a height 705 of 1.63 mm and an outer lip angle 706 of 22° 15'. The outer ring 703 further includes an outer nub 704 designed to help retain the liner in the aluminum screw cap. The cap liner 700 has a similar liner profile to the cap liner 400 but with a modified outer lip height 705.

Figure 8A:
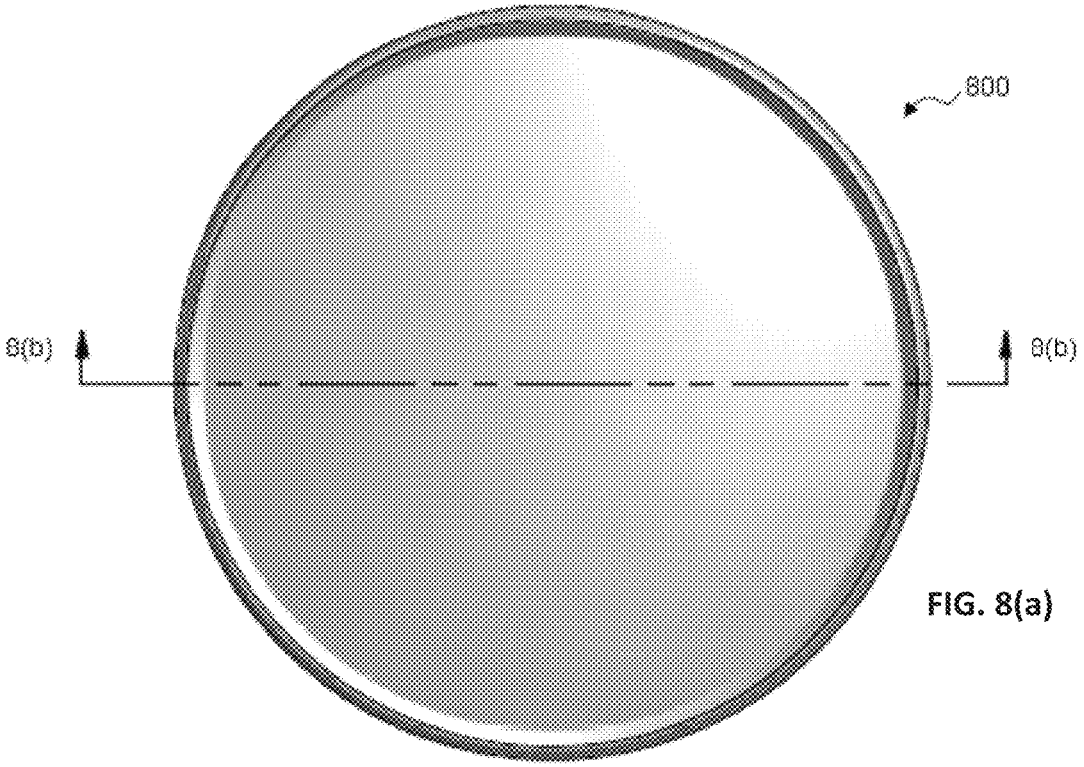
FIG. 8(*a*) illustrates a top view of another exemplary cap liner, according to one embodiment.
Figure 8B:
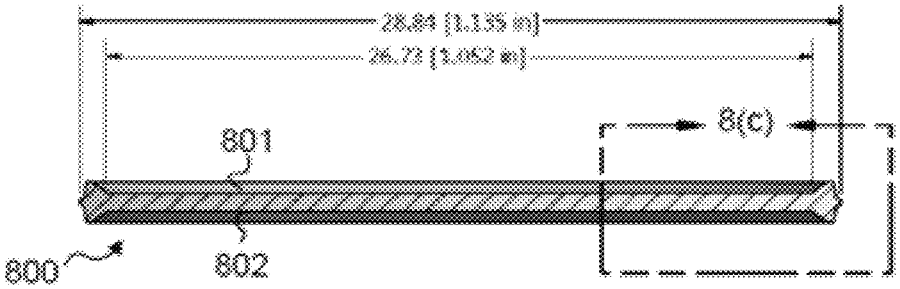
Figure 8C:
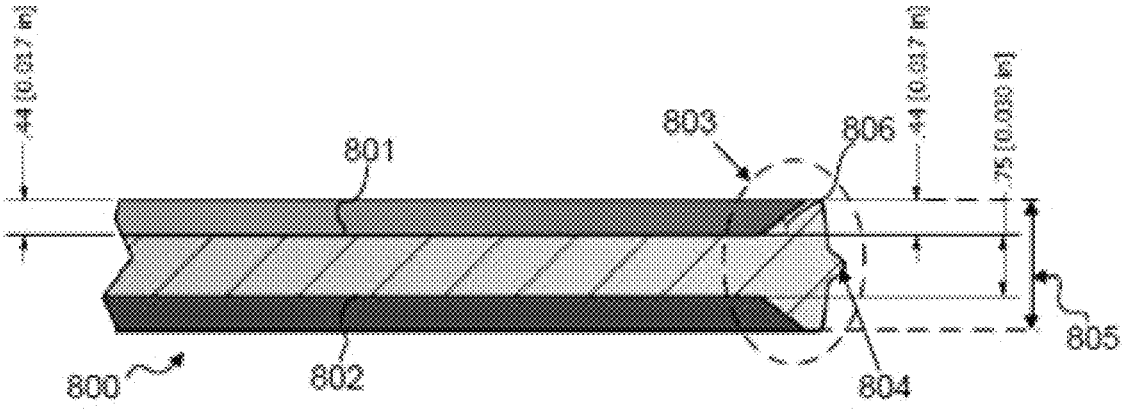

FIGS. 8(*a*)-8(*c*) illustrate respectively a top view, a cross-sectional view, and a detailed cross-sectional view of another exemplary cap liner designed for use in a 30 mm diameter aluminum top-side seal closure, according to one embodiment. The cap liner 800 is of a circular disc shape with a diameter of 28.84 mm. The cap liner 800 includes two circular-shaped cavities 801 and 802 that are each depressed into both sides of the cap liner 800. Each circular-shaped cavity 801 and 802 has a diameter of 26.73 mm. The two circular-shaped cavities 801 and 802 create an outer ring 803 ("outer lip") directly adjacent to a circumference of the cap liner 800. The outer lip 803 has a height 805 of 1.63 mm and an outer lip angle 806 of 37° 15. The outer ring 803 further includes an outer nub 804 designed to help retain the liner in the aluminum screw cap. The cap liner 800 has a similar liner profile to the cap liner 400 but with a modified outer lip height 805 and a modified outer lip angle 806.

Figure 9:
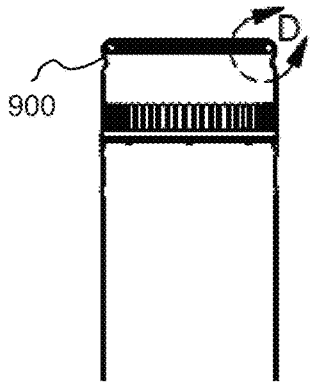
FIG. 9(*a*) illustrates a cross-sectional view of another exemplary cap liner in a screw cap, according to one embodiment.
Figure 9:
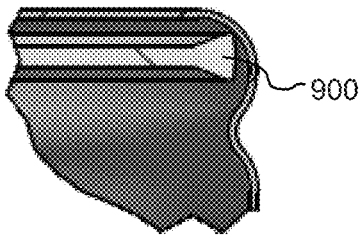
Figure 9:
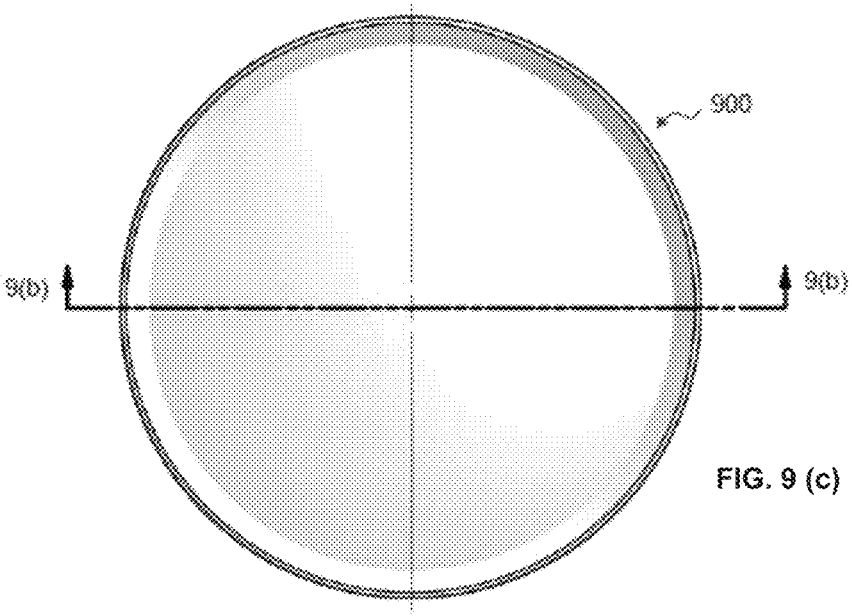
Figure 9:
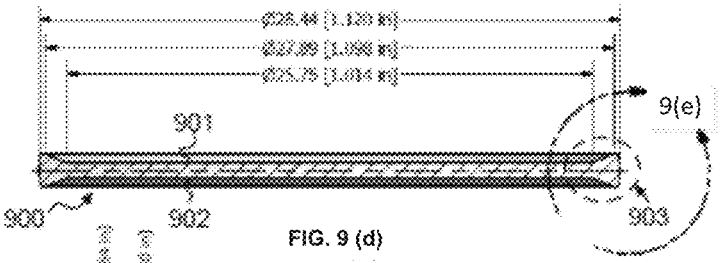
Figure 9:
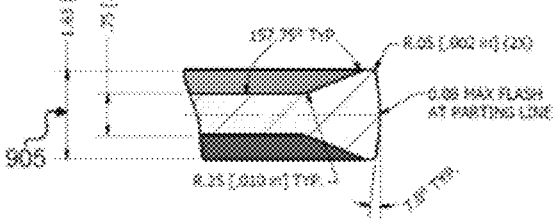

FIGS. 9(*a*)-9(*b*) illustrate a cross-sectional view and a detailed cross-sectional view of another exemplary cap liner in a screw cap as, according to one embodiment. FIGS. 9(*c*)-9(*e*) illustrate respectively a top view, a cross-sectional view, and a detailed cross-sectional view of another exemplary cap liner as illustrated in FIG. 9(*b*), designed for use in a 30 mm diameter aluminum top-side seal closure, according to one embodiment. The cap liner 900 is of a circular disc shape with a diameter of 28.44 mm. The cap liner 900 includes two circular-shaped cavities 901 and 902 that are each depressed into both sides of the cap liner 900. Each circular-shaped cavity 901 and 902 has a diameter of 25.75 mm. The two circular-shaped cavities 901 and 902 create an outer ring 903 ("outer lip") directly adjacent to a circumference of the cap liner 900. The outer lip 903 has a height 905 of 1.63 mm. The cap liner 900 does not include an outer nub allowing the cap liner 900 to be more easily inserted into an aluminum cap shell while still maintaining enough of an interference fit to keep it solidly retained in the finished cap.

Figure 10:
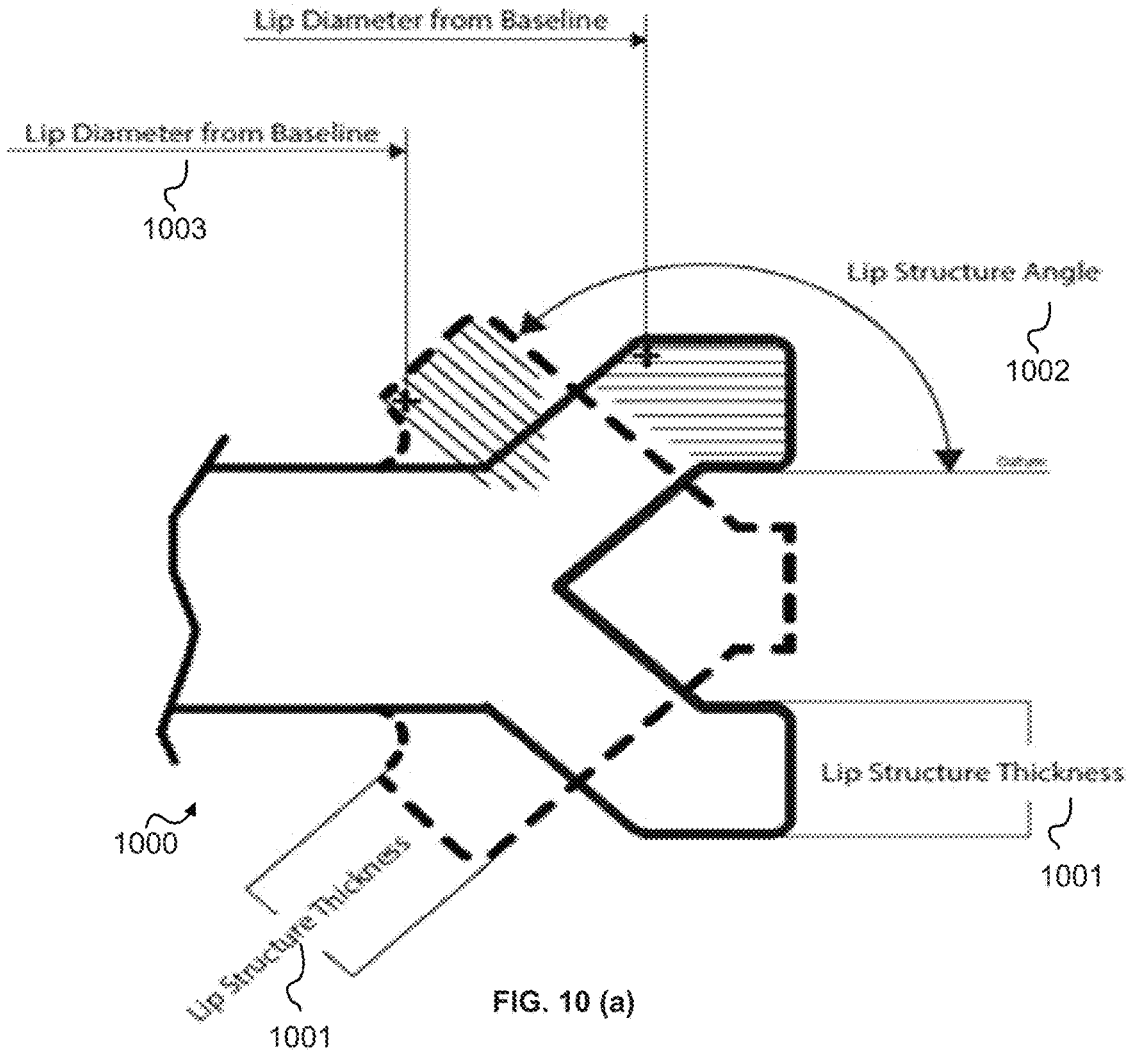
FIG. 10(*a*) illustrates a detailed cross-section of an outer lip diagram showing how outer lip designs, according to one embodiment.

FIG. 10(*a*) illustrates a detailed cross-section of an outer lip diagram showing outer lip designs, according to one embodiment. FIG. 10(*a*) further illustrates a thickness 1001 of the outer lip structure 1000, an outer lip angle 1002 measured with respect to a reference line ("datum") and a diameter 1003 of the outer lip structure 1000 measured from a baseline relative to the other liners in the study.

FIG. 10(*b*) illustrates a the effect of various liner outer lip structural elements on the liner performance characteristics, according to one embodiment. The table 1004 illustrates the outer lip angle ("lip structure angle") 1002 measured with respect to a reference line ("datum"), the thickness 1001 of the outer lip structure ("lip structure thickness") and the diameter 1003 of the outer lip measured relative to the liners in the study, for seven different liner outer lip profiles used in the test. FIGS. 11-17 illustrate these seven test samples in detail.

Figure 11A:
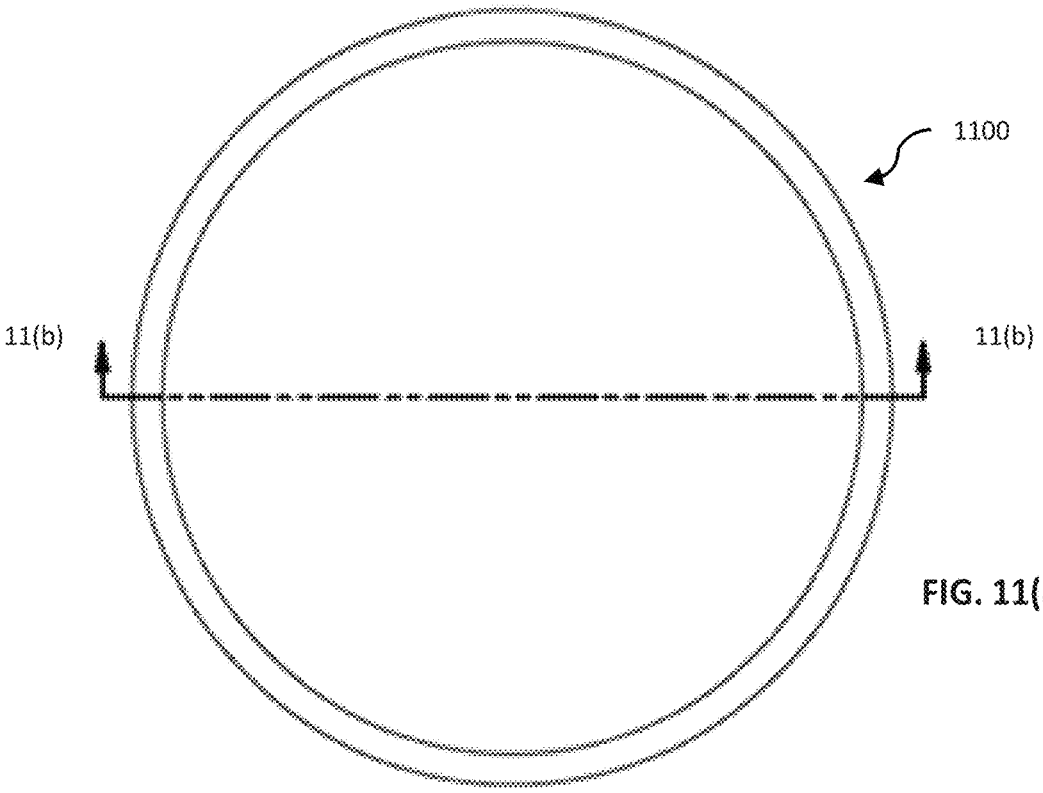
FIG. 11(*a*) illustrates a top view of another exemplary cap liner, according to one embodiment.
Figure 11B:
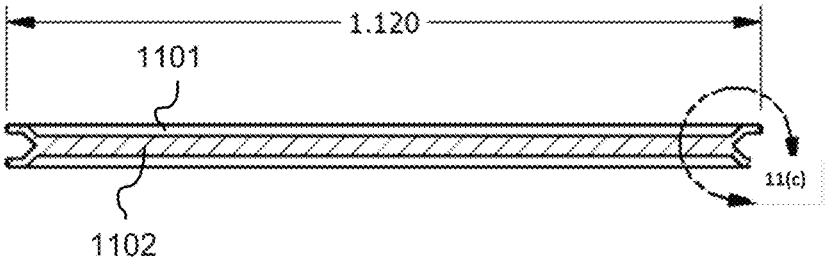
Figure 11C:
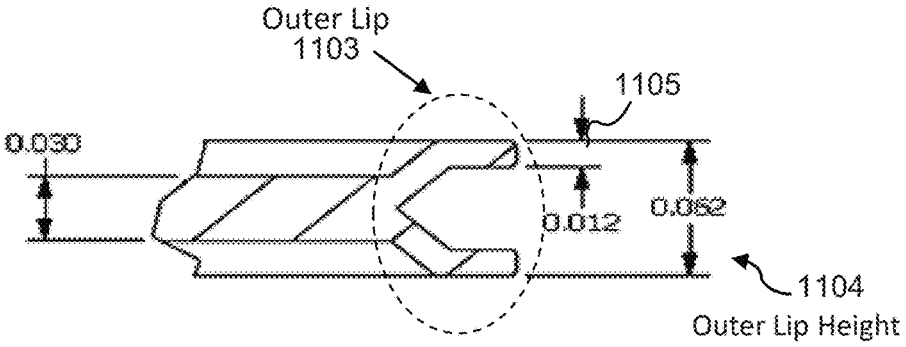

FIGS. 11(*a*)-11(*c*) illustrate respectively a top view, a cross-sectional view, and a detailed cross-sectional view of another exemplary cap liner designed for use in a 30 mm diameter aluminum top-side seal closure, according to one embodiment. The cap liner 1100 is of a circular disc shape with a diameter of 1.120 in. The cap liner 1100 includes two circular-shaped cavities 1101 and 1102 that are each depressed into both sides of the cap liner 1100. The two circular-shaped cavities 1101 and 1102 create an outer ring 1103 ("outer lip") directly adjacent to a circumference of the cap liner 1100. The outer lip 1103 has an overall height 1104 of 0.062 in, lip structure thickness 1105 of 0.012 in and an outer lip angle of 0°.

Figure 12A:
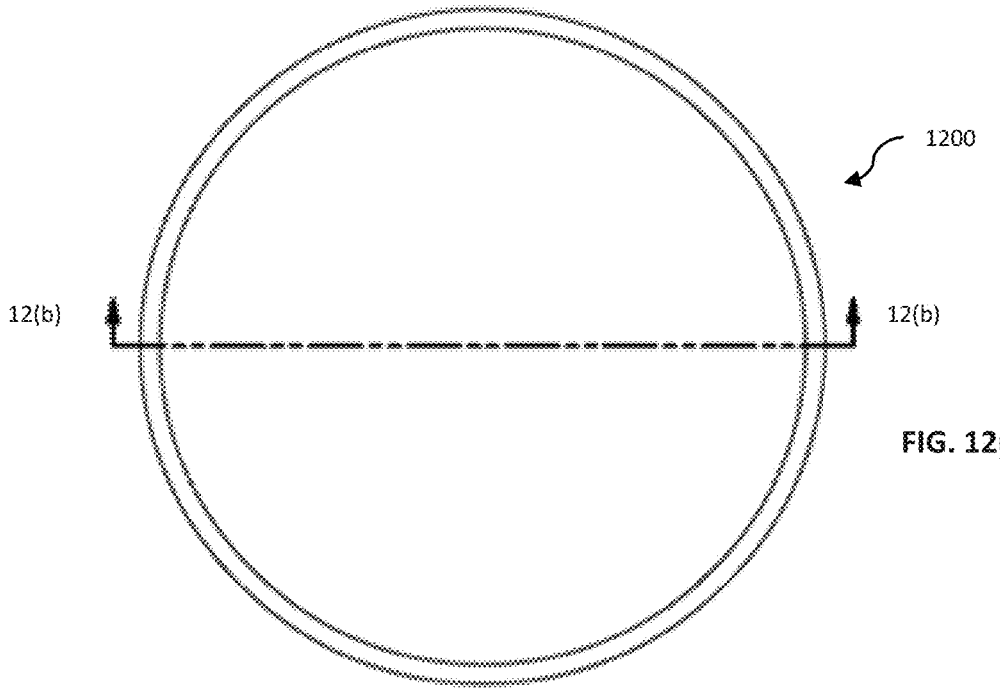
FIG. 12(*a*) illustrates a top view of another exemplary cap liner, according to one embodiment.
Figure 12B:
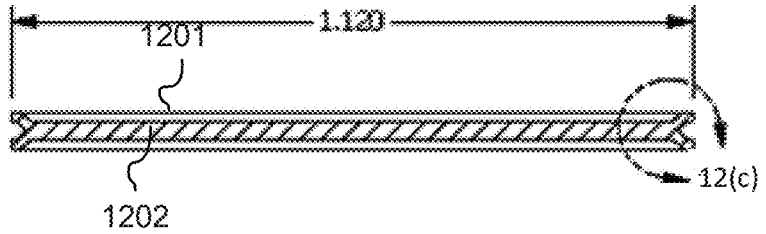
Figure 12C:
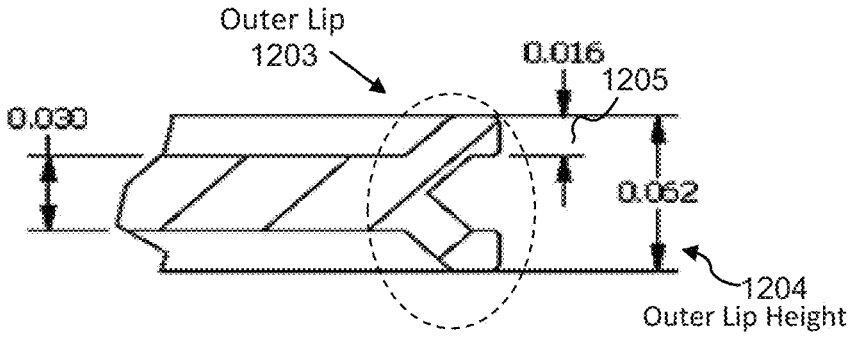

FIGS. 12(*a*)-12(*c*) illustrate respectively a top view, a cross-sectional view, and a detailed cross-sectional view of another exemplary cap liner designed for use in a 30 mm diameter aluminum top-side seal closure, according to one embodiment. The cap liner 1200 is of a circular disc shape with a diameter of 1.120 in. The cap liner 1200 includes two circular-shaped cavities 1201 and 1202 that are each depressed into both sides of the cap liner 1200. The two circular-shaped cavities 1201 and 1202 create an outer ring 1203 ("outer lip") directly adjacent to a circumference of the cap liner 1200. The outer lip 1203 has an overall height 1204 of 0.062 in, lip structure thickness 1205 of 0.016 in and an outer lip angle of 0°.

Figure 13A:
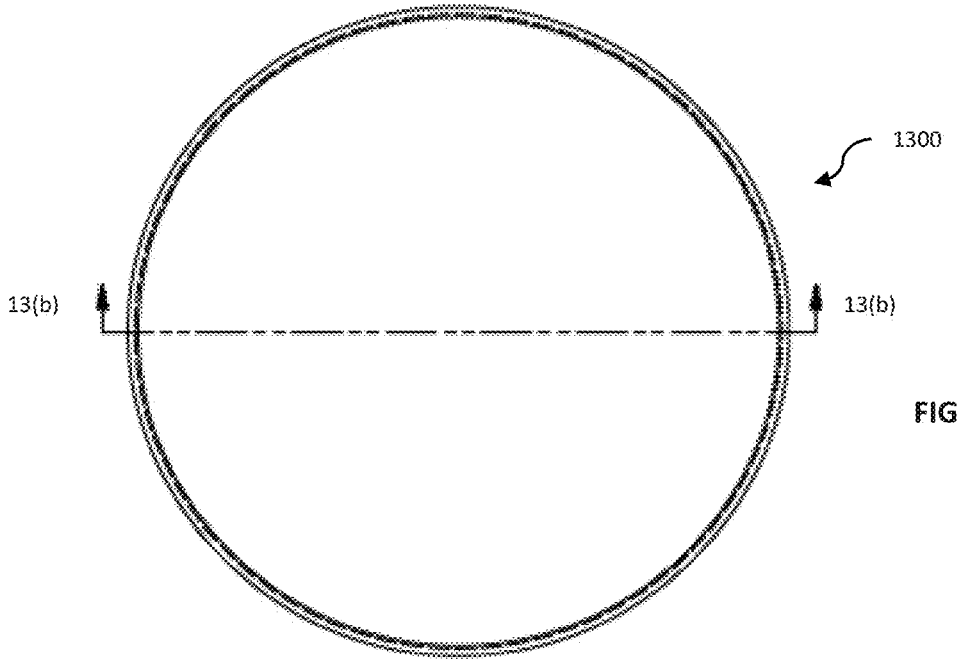
FIG. 13(*a*) illustrates a top view of another exemplary cap liner according to one embodiment.
Figure 13B:
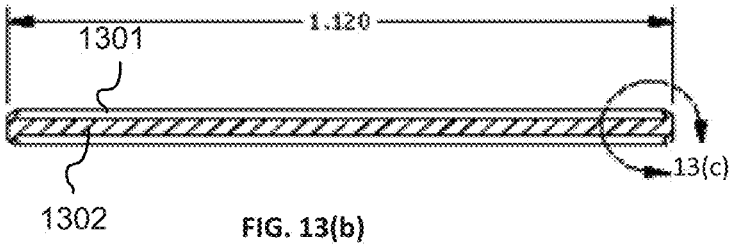
Figure 13C:
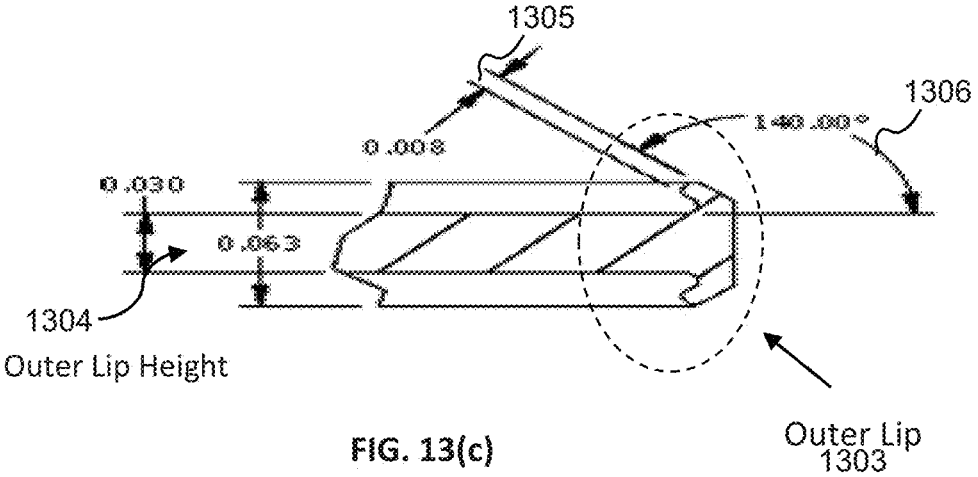

FIGS. 13(*a*)-13(*c*) illustrate respectively a top view, a cross-sectional view, and a detailed cross-sectional view of another exemplary cap liner designed for use in a 30 mm diameter aluminum top-side seal closure, according to one embodiment. The cap liner 1300 is of a circular disc shape with a diameter of 1.120 in. The cap liner 1300 includes two circular-shaped cavities 1301 and 1302 that are each depressed into both sides of the cap liner 1300. The two circular-shaped cavities 1301 and 1302 create an outer ring 1303 ("outer lip") directly adjacent to a circumference of the cap liner 1300. The outer lip 1303 has an overall height 1304 of 0.063 in, lip structure thickness 1305 of 0.008 in and an outer lip angle 1306 of 140°.

Figure 14A:
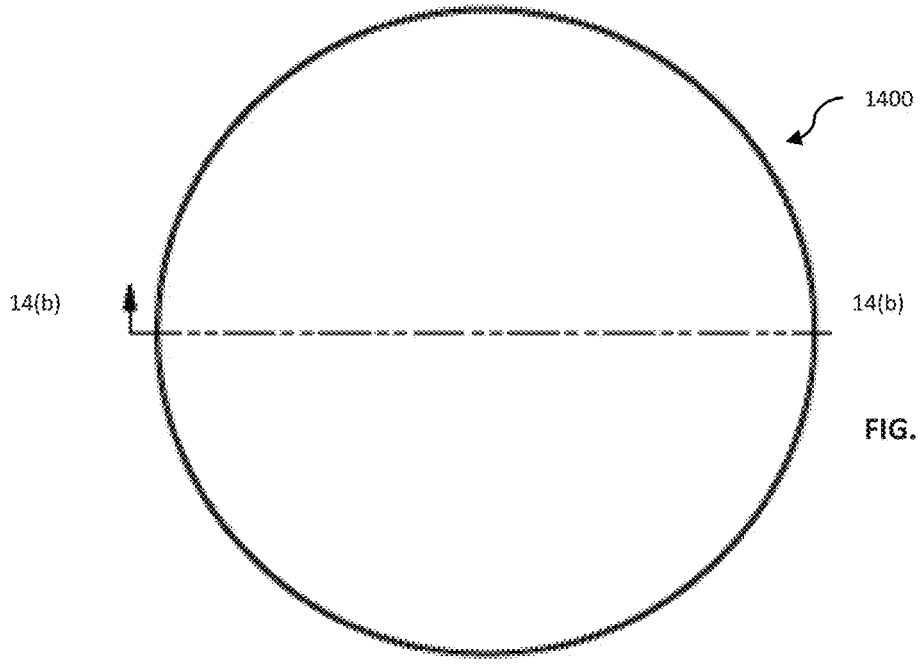
FIG. 14(*a*) illustrates a top view of another exemplary cap liner according to one embodiment.
Figure 14B:
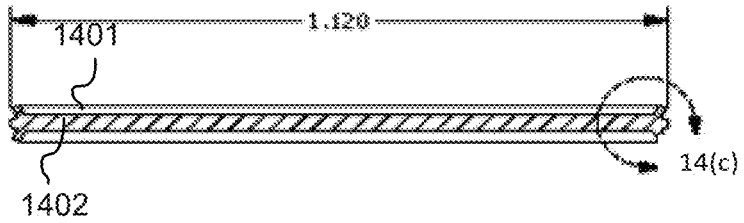
Figure 14C:
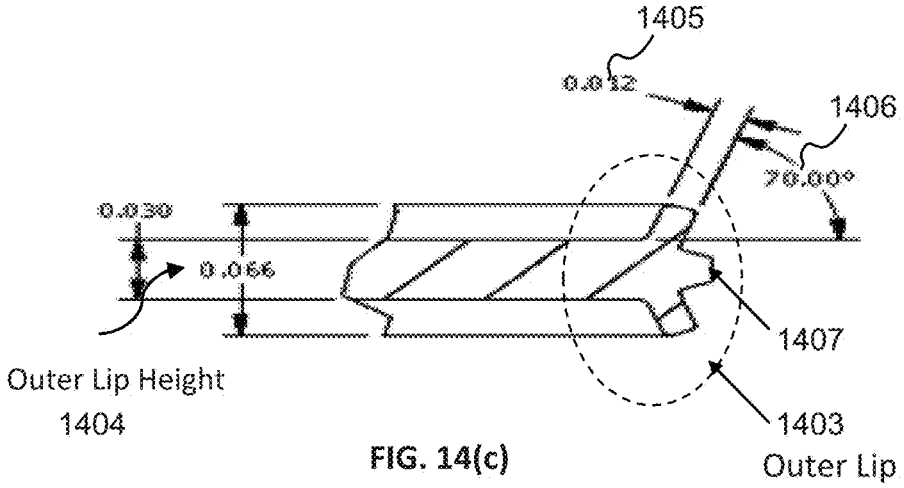

FIGS. 14(*a*)-14(*c*) illustrate respectively a top view, a cross-sectional view, and a detailed cross-sectional view of another exemplary cap liner designed for use in a 30 mm diameter aluminum top-side seal closure, according to one embodiment. The cap liner 1400 is of a circular disc shape with a diameter of 1.120 in. The cap liner 1400 includes two circular-shaped cavities 1401 and 1402 that are each depressed into both sides of the cap liner 1400. The two circular-shaped cavities 1401 and 1402 create an outer ring 1403 ("outer lip") directly adjacent to a circumference of the cap liner 1400. The outer lip 1403 has a height 1404 of 0.066 in, thickness 1405 of 0.012 in and an outer lip angle 1406 of 70°. Due to the outer diameter reduction of this liner, created by the designed experiment's factor levels, an outer "nub" 1407 was added to the outer lip 1403 to help retain the liner in the aluminum screw cap.

Figure 15A:
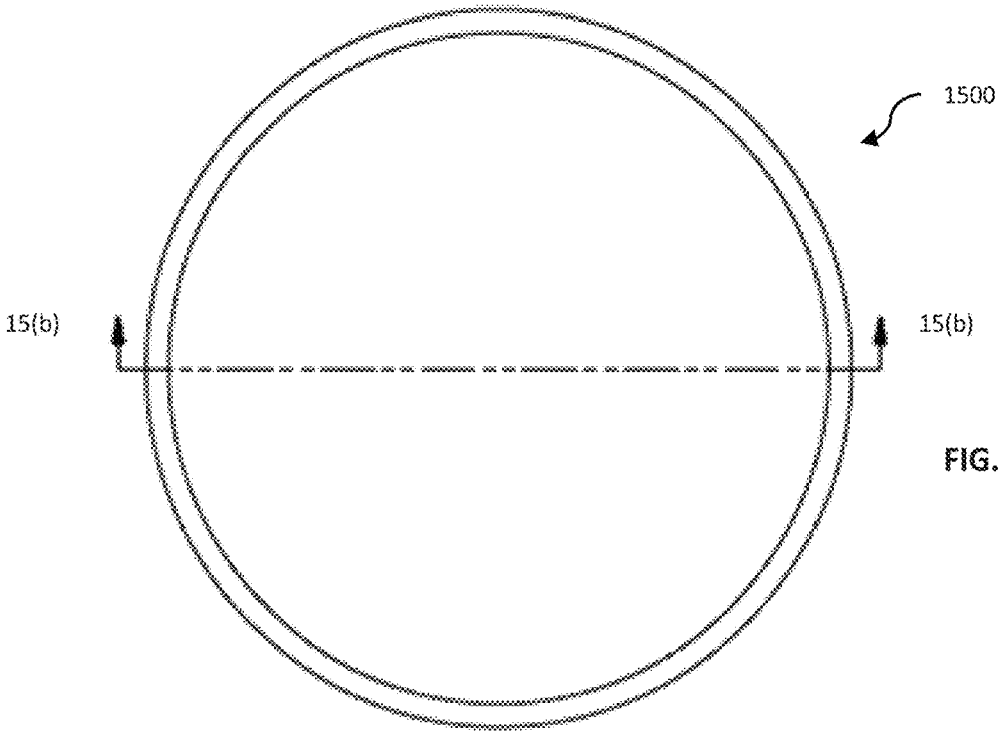
FIG. 15(*a*) illustrates a top view of another exemplary cap liner according to one embodiment.
Figure 15B:
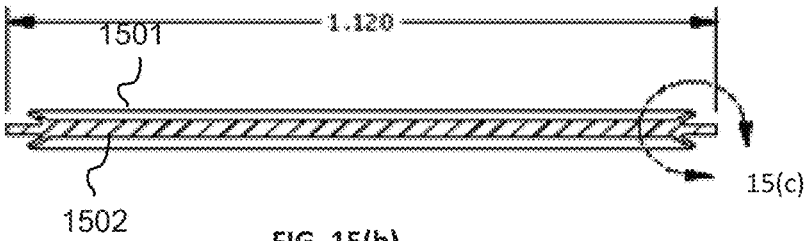
Figure 15C:
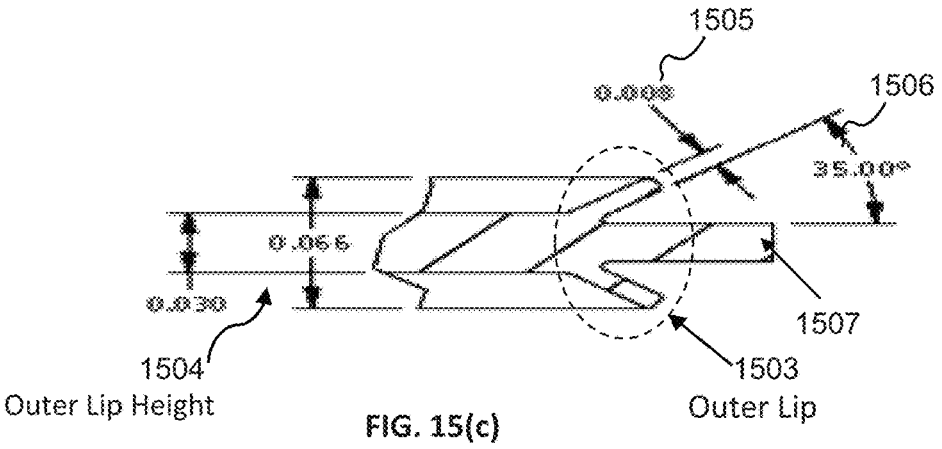

FIGS. 15(*a*)-15(*c*) illustrate respectively a top view, a cross-sectional view, and a detailed cross-sectional view of another exemplary cap liner designed for use in a 30 mm diameter aluminum top-side seal closure, according to one embodiment. The cap liner 1500 is of a circular disc shape with a diameter of 1.120 in. The cap liner 1500 includes two circular-shaped cavities 1501 and 1502 that are each depressed into both sides of the cap liner 1500. The two circular-shaped cavities 1501 and 1502 create an outer ring 1503 ("outer lip") directly adjacent to a circumference of the cap liner 1500. The outer lip 1503 has an overall height 1504 of 0.066 in, lip structure thickness 1505 of 0.008 in and an outer lip angle 1506 of 35°. Due to the outer diameter reduction of this liner, created by the designed experiment's factor levels, an outer "nub" 1507 was added to the outer lip 1503 to help retain the liner in the aluminum screw cap.

Figure 16A:
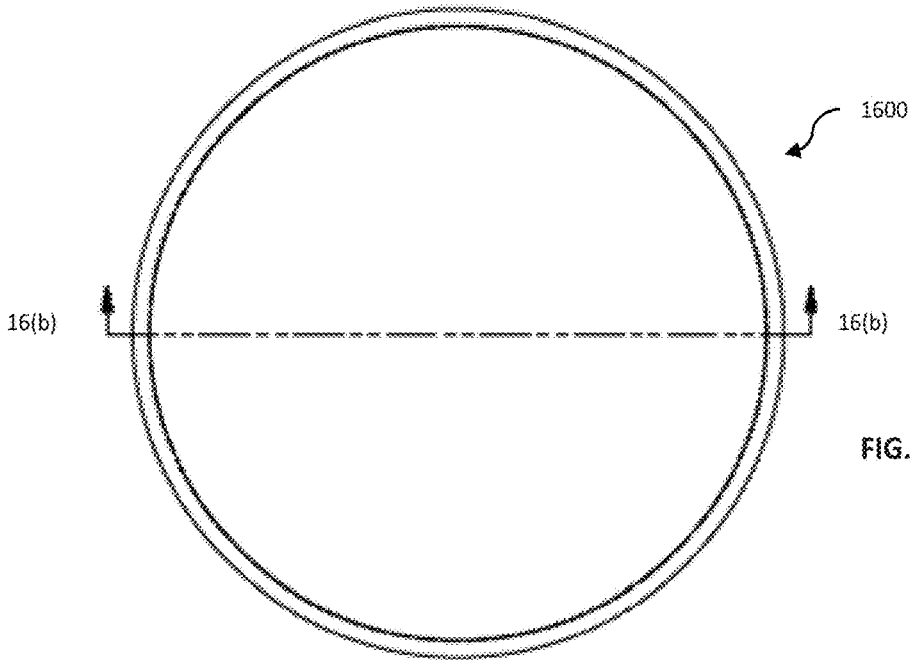
FIG. 16(*a*) illustrates a top view of another exemplary cap liner according to one embodiment.
Figure 16B:
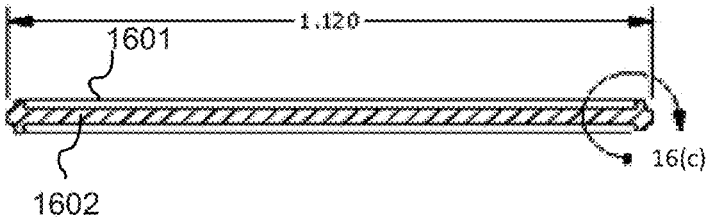
Figure 16C:
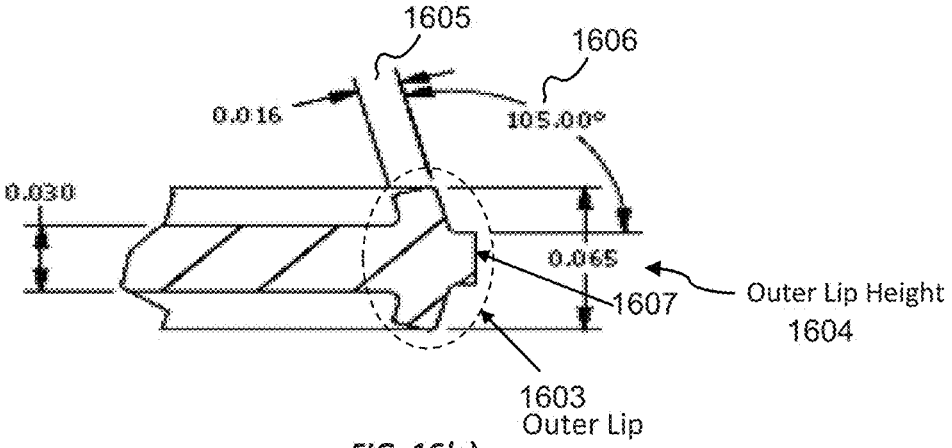

FIGS. 16(*a*)-16(*c*) illustrate respectively a top view, a cross-sectional view, and a detailed cross-sectional view of another exemplary cap liner designed for use in a 30 mm diameter aluminum top-side seal closure, according to one embodiment. The cap liner 1600 is of a circular disc shape with a diameter of 1.120 in. The cap liner 1600 includes two circular-shaped cavities 1601 and 1602 that are each depressed into both sides of the cap liner 1600. The two circular-shaped cavities 1601 and 1602 create an outer ring 1603 ("outer lip") directly adjacent to a circumference of the cap liner 1600. The outer lip 1603 has an overall height 1604 of 0.065 in, lip structure thickness 1605 of 0.016 in and an outer lip angle 1606 of 105°. Due to the outer diameter reduction of this liner, created by the designed experiment's factor levels, an outer "nub" 1607 was added to the outer lip 1603 to help retain the liner in the aluminum screw cap.

Figure 17A:
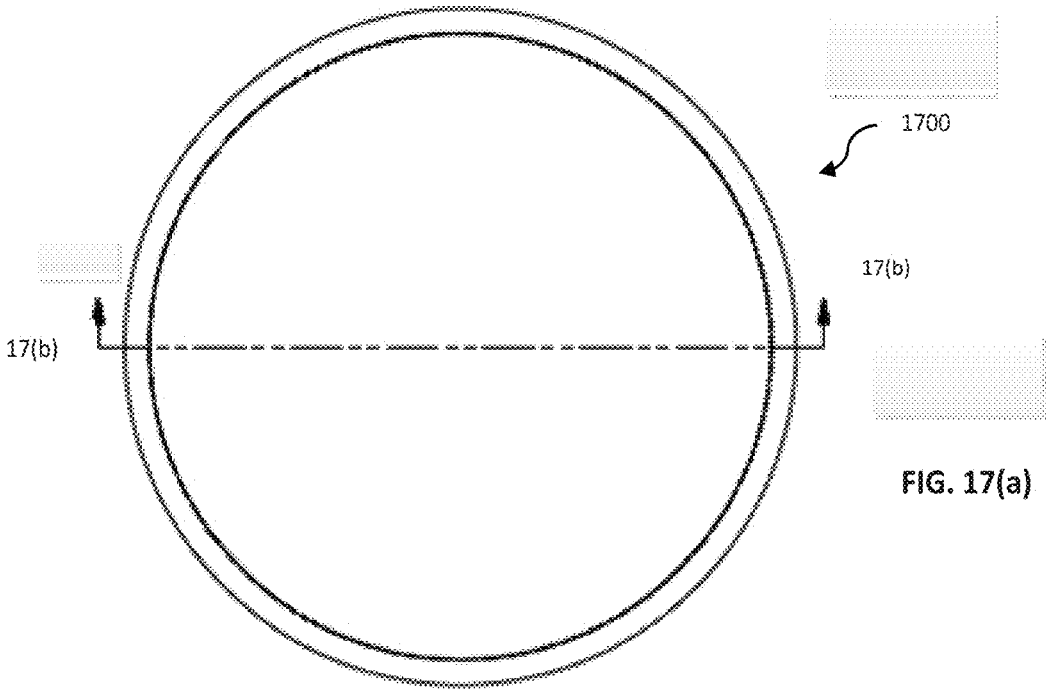
FIG. 17(*a*) illustrates a top view of another exemplary cap liner according to one embodiment.
Figure 17B:
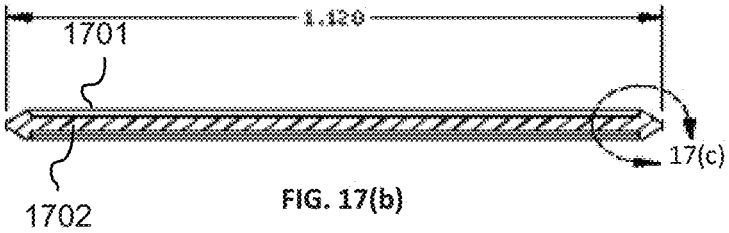
Figure 17C:
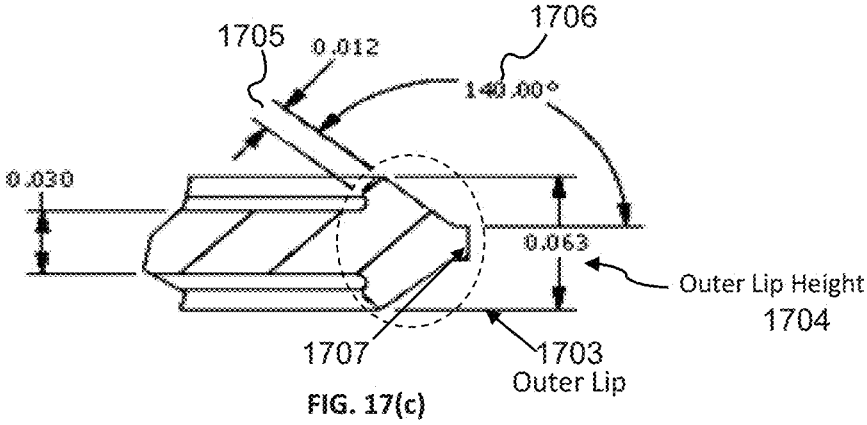

FIGS. 17(*a*)-17(*c*) illustrate respectively a top view, a cross-sectional view, and a detailed cross-sectional view of another exemplary cap liner designed for use in a 30 mm diameter aluminum top-side seal closure, according to one embodiment. The cap liner 1700 is of a circular disc shape with a diameter of 1.120 in. The cap liner 1700 includes two circular-shaped cavities 1701 and 1702 that are each depressed into both sides of the cap liner 1700. The two circular-shaped cavities 1701 and 1702 create an outer ring 1703 ("outer lip") directly adjacent to a circumference of the cap liner 1700. The outer lip 1703 has an overall height 1704 of 0.063 in, lip structure thickness 1705 of 0.012 in and an outer lip angle 1706 of 140°. Due to the outer diameter reduction of this liner, created by the designed experiment's factor levels, an outer "nub" 1707 was added to the outer lip 1703 to help retain the liner in the aluminum screw cap.

Figure 18A:
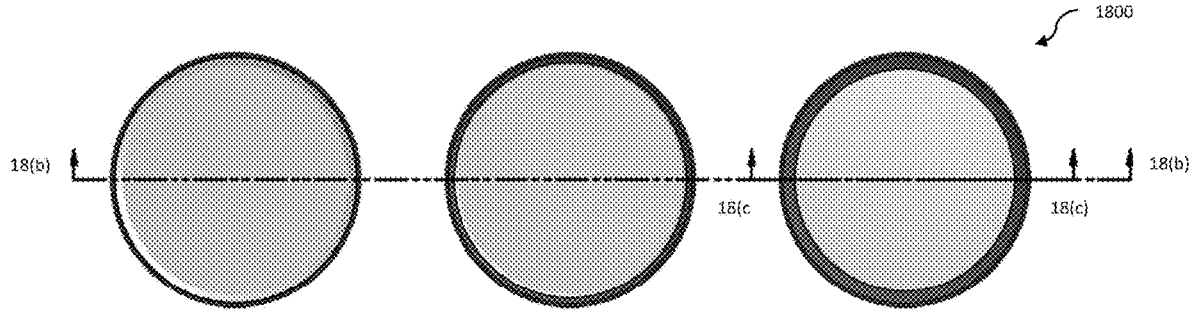
FIG. 18(*a*) illustrates a top view of another exemplary cap liner according to one embodiment.
Figure 18B:
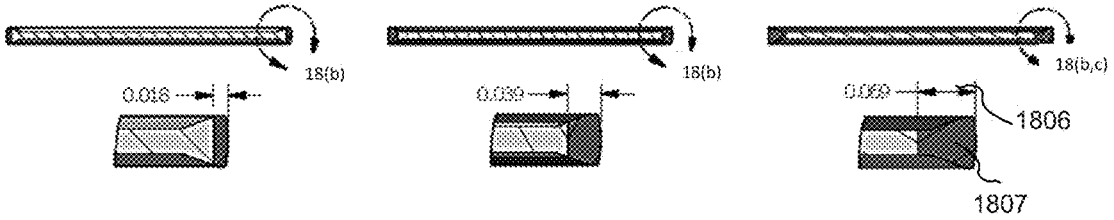
Figure 18C:
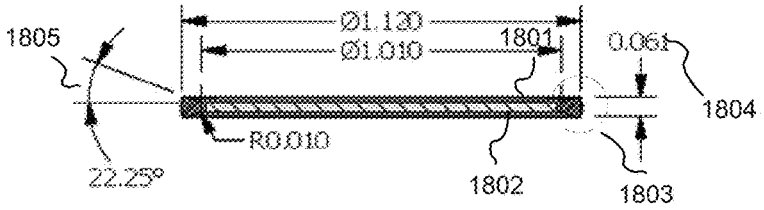

FIGS. 18(*a*)-18(*c*) illustrate respectively a top view, a cross-sectional view, and a detailed cross-sectional view of another exemplary cap liner designed for use in a 30 mm diameter aluminum top-side seal closure, according to one embodiment. The cap liner 1800 is of a circular disc shape with a diameter of 1.120 in. The cap liner 1800 includes two circular-shaped cavities 1801 and 1802 that are each depressed into both sides of the cap liner 1800. Each circular-shaped cavity 1801 and 1802 has a diameter of 1.010 in. The two circular-shaped cavities 1801 and 1802 create an outer ring 1803 ("outer lip") directly adjacent to a circumference of the cap liner 1800. The outer lip 1803 has a height 1804 of 0.061 in and an outer lip angle 1805 of 22.25°. Dual injection molding technique is used to create the outer lip 1803 or portions thereof with a different material than the remainder of the liner. For example, low density polyethylene (LDPE) may be used to create the inner portions of the liner 1800, and thermoplastic elastomers (TPE) may be over-molded to the LDPE to form the liner's outer edge including the entire outer lip 1803 or just portions of the outer lip. The thickness of the over-molded TPE material can vary during the molding process depending on the amount of TPE required to obtain the desired effect. For example, as shown in FIG. 18(*b*), the thickness of the over-molded portion 1807 on the outside edge of the liner 1800 can be 0.018 in, 0.039 in, 0.069 in cross-sectional width or the like, depending on the amount of TPE desired in the final liner design. The cap liner 1800 does not include an outer nub allowing the cap liner 1800 to be more easily inserted into an aluminum cap shell while still maintaining enough of an interference fit to keep it solidly retained in the finished cap.

Figure 19A:
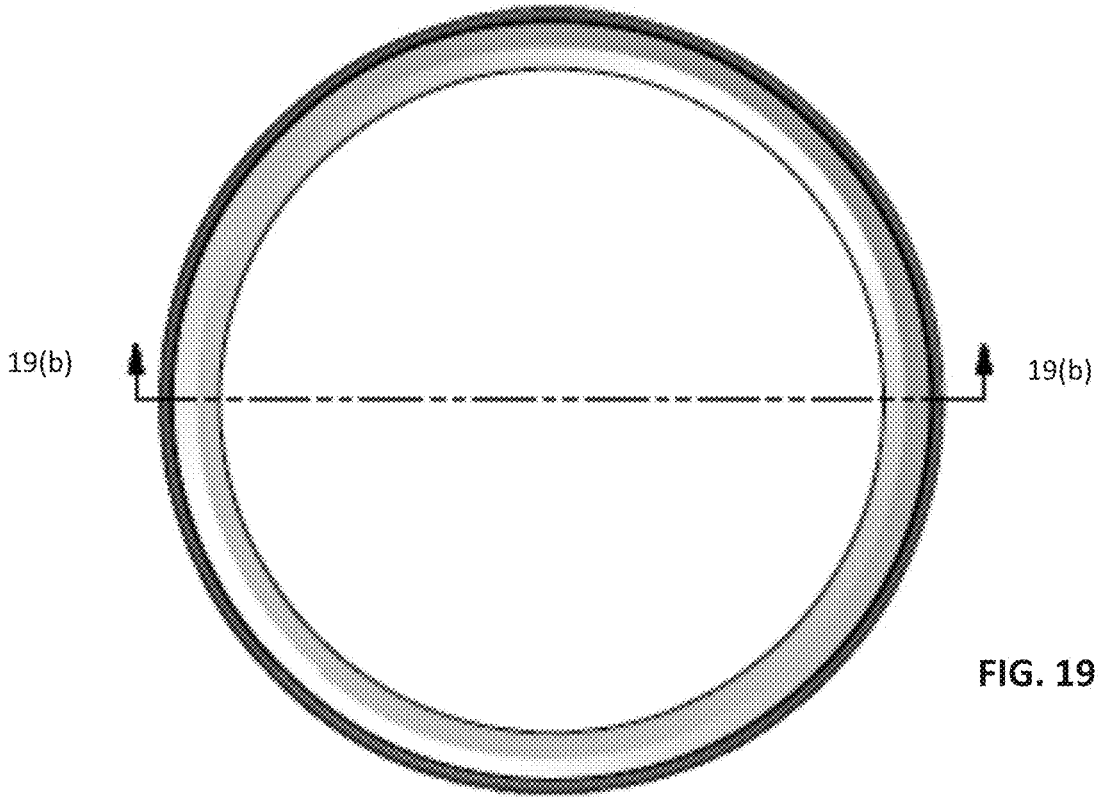
FIG. 19(*a*) illustrates a top view of another exemplary cap liner according to one embodiment.
Figure 19B:
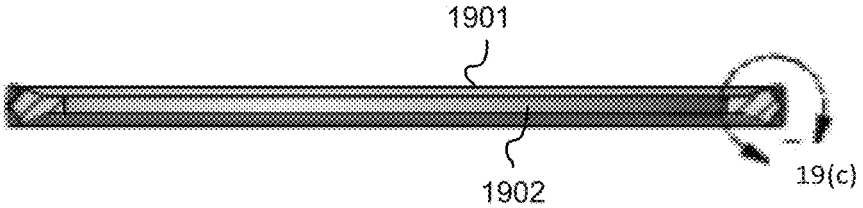
Figure 19C:
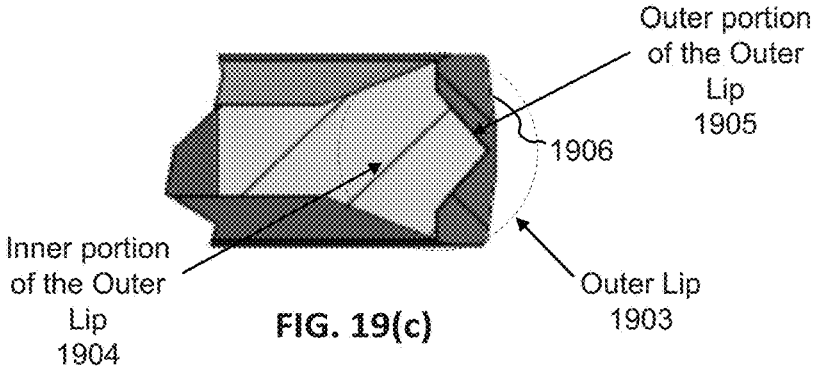

FIGS. 19(*a*)-19(*c*) illustrate respectively a top view, a cross-sectional view, and a detailed cross-sectional view of another exemplary cap liner designed for use in a 30 mm diameter aluminum top-side seal closure, according to one embodiment. In this exemplary embodiment, the cap liner's 1900 center is removed to save material and therefore reduce the manufacturing cost. The cap liner 1900 is consequently of a circular ring shape with a diameter of 1.120 in. The cap liner 1900 includes two annular surfaces 1901 and 1902. The annular surfaces 1901 and 1902 are each depressed into both sides of the cap liner 1900 ring and create an outer lip 1903 directly adjacent to a circumference of the cap liner 1900. The outer lip 1903 includes an inner portion 1904 and an outer portion 1905. Dual injection molding technique is used to create the annular surfaces 1901 and 1902 and an over-mold 1906 creating the outer portion 1905 of the outer lip 1903. The material used to create the outer portion of the outer lip 1905 may encroach on the inner portion of the outer lip 1904 depending on the liner's functional requirements. Low density polyethylene (LDPE), polypropylene (PP), or any material providing the appropriate properties, such as rigidity, is used for inner portion 1904 of the outer lip 1903 formed by the annular surfaces 1901 and 1902, and a thermoplastic elastomer (TPE), polyethylene terephthalate (PET), high-density polyethylene (HDPE), polyamide or other material providing appropriate properties, such as reduced oxygen transmission, is used for the over-mold 1906 portion of the cap liner 1900 including all or some of the outer lip 1903. The outer lip 1903 may be shaped as necessary to provide for the proper performance characteristics. The triangular shape of the outer lip 1903 is designed to help to provide a larger surface area and a better LDPE to TPE adhesive strength to maintain the liner's integrity.

Figure 20:
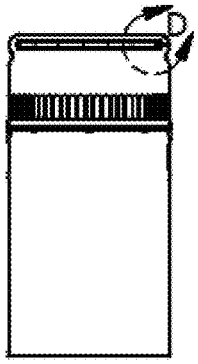
FIG. 20(*a*) illustrates a cross-sectional view of another exemplary cap liner in a screw cap, according to one embodiment.
Figure 20:
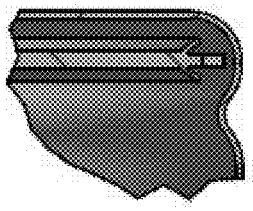
Figure 20:
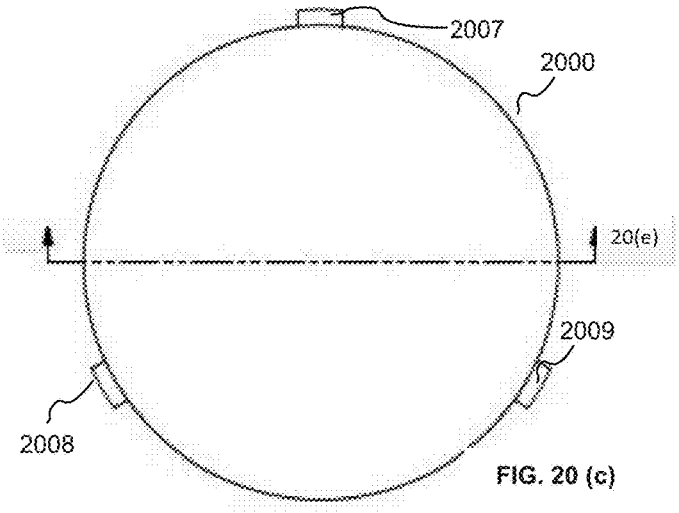
Figure 20:
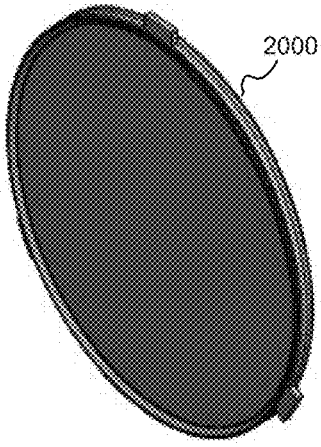
Figure 20:
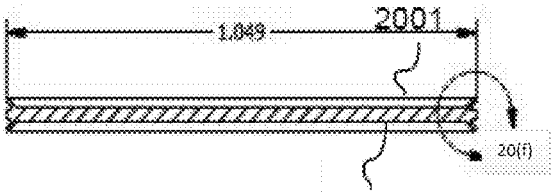
Figure 20:
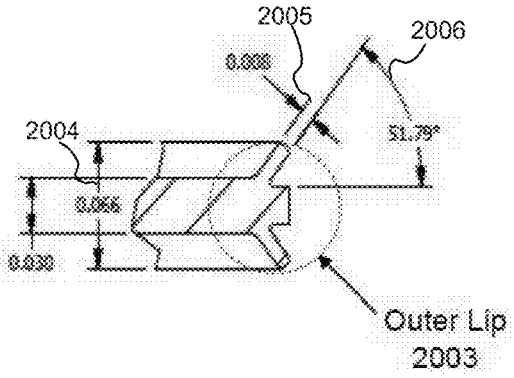

FIGS. 20(*a*)-20(*b*) illustrate a cross-sectional view and a detailed cross-sectional view of another exemplary cap liner in a screw cap as, according to one embodiment. FIGS. 20(*c*)-20(*f*) illustrate respectively a top view, a 3-dimensional view, a cross-sectional view, and a detailed cross-sectional view of another exemplary cap liner as illustrated in FIG. 20(*b*), designed for use in a 30 mm diameter aluminum top-side seal closure, according to one embodiment. The cap liner 2000 is of a circular disc shape with a diameter of 1.049 in. The cap liner 2000 includes two circular-shaped cavities 2001 and 2002 that are each depressed into both sides of the cap liner 2000. The two circular-shaped cavities 2001 and 2002 create an outer ring 2003 ("outer lip") directly adjacent to a circumference of the cap liner 2000. The outer lip 2003 has a height 2004 of 0.066 in, thickness 2005 of 0.008 in and an outer lip angle 2006 of 51.79°. The outer lip 2003 further includes three tabs 2007, 2008, 2009, that are created by removing extra material from the outer lip 2003 nub to help reduce the amount of material and cost. The three tabs 2007, 2008, 2009 provide enough of an interference fit to keep the liner solidly retained in the finished cap.

Figure 21:
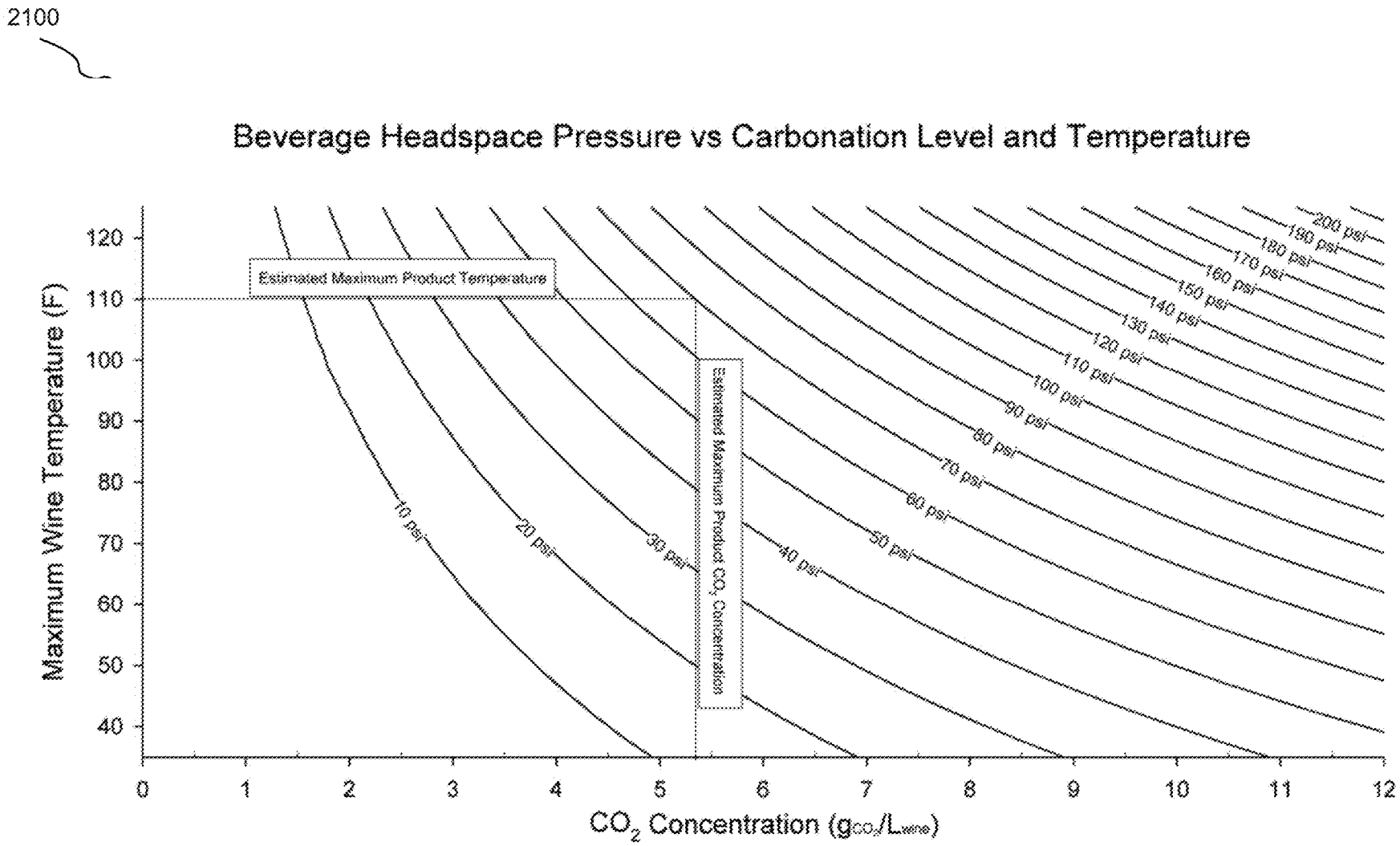
FIG. 21 illustrates an exemplary graph for determining a maximum internal package pressure in a rigid container filled to the appropriate volume, according to one embodiment.

FIG. 21 illustrates an exemplary graph for determining a maximum internal package pressure in a rigid container filled to the appropriate volume, according to one embodiment. A plot 2100 illustrates that for a maximum wine temperature of about 110° F. and a carbon dioxide concentration in the beverage of about 5.4 gram/liter, the expected maximum product pressure is 70 psi.

FIGS. 22-25 illustrate exemplary plots of the effect of various types of cap liners on slip torque, break torque, secure seal test (SST), and oxygen transmission rate (OTR) respectively, according to one embodiment. In particular, FIGS. 22-25 illustrate plots of the effect of the cap liner's material and physical profiles LDPE-1, LDPE-2, LDPE-3, LDPE-4, LDPE-5, Oxylon 420-1, Oxylon 420-2, Oxylon 420-3, Oxylon 420-4, Oxylon 420-5 on slip torque, break torque, SST, and OTR, respectively.

Figure 22:
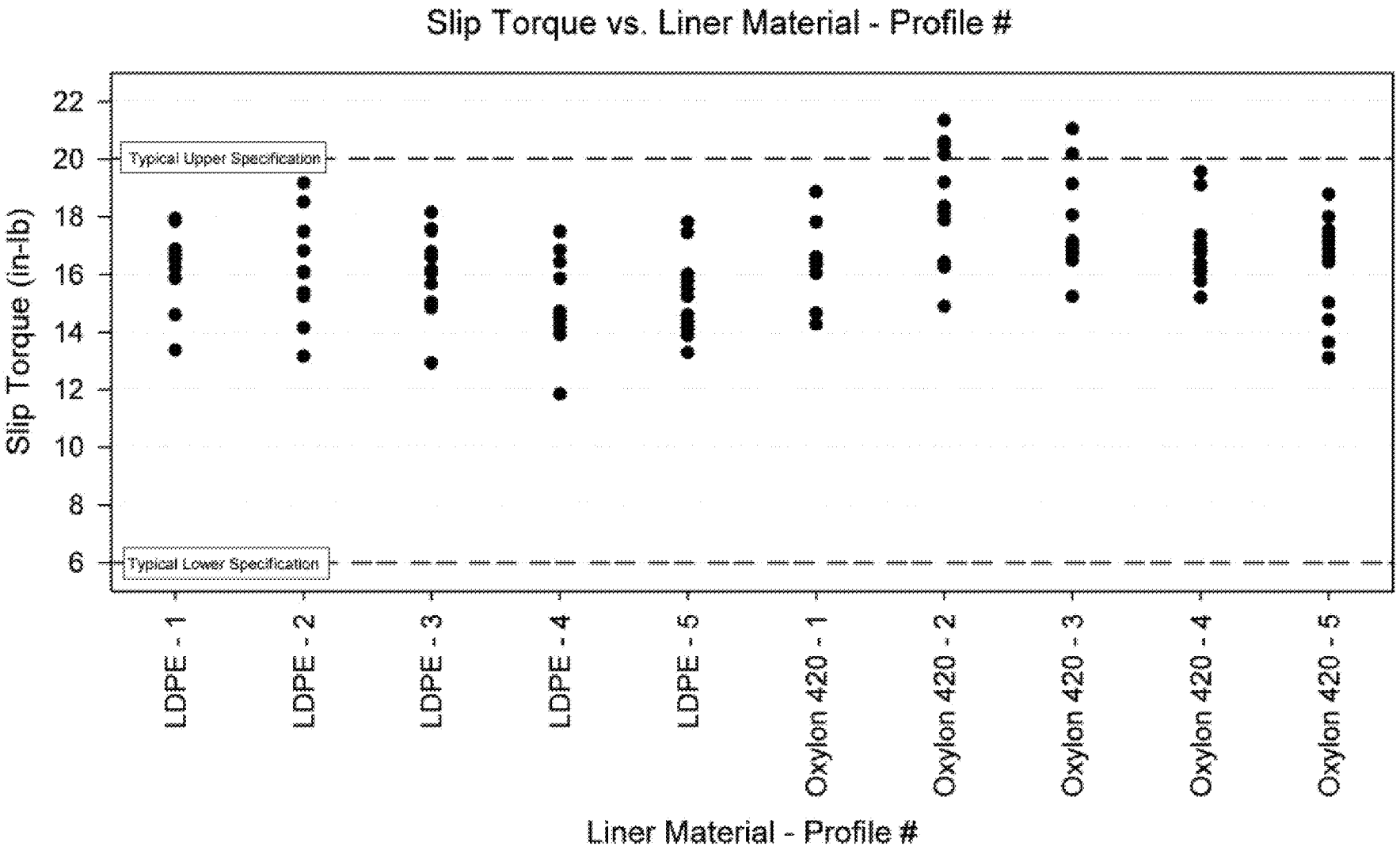
FIG. 22 illustrates an exemplary plot of the effect of various types of cap liners on slip torque, according to one embodiment.

Referring to FIG. 22, the slip torque distributions for cap liners made of a TPE called OXYLON® 420 (e.g., Oxylon 420-3, Oxylon 420-4, and Oxylon 420-5) indicate higher slip torques than the cap liners made of a LDPE liner material (e.g., LDPE-1, LDPE-2, LDPE-3, LDPE-4, and LDPE-5). According to one embodiment, adjustments to the slip torque can be made by using a slip agent. The slip agent can be based upon any of a number of materials approved for food contact that are added to the liner material of a liner profile to reduce slip torque. These slip agents include, but are not limited to, amides, erucamide, oleamide, polyethylene beads, lanolin, and carnauba waxes.

Figure 23:
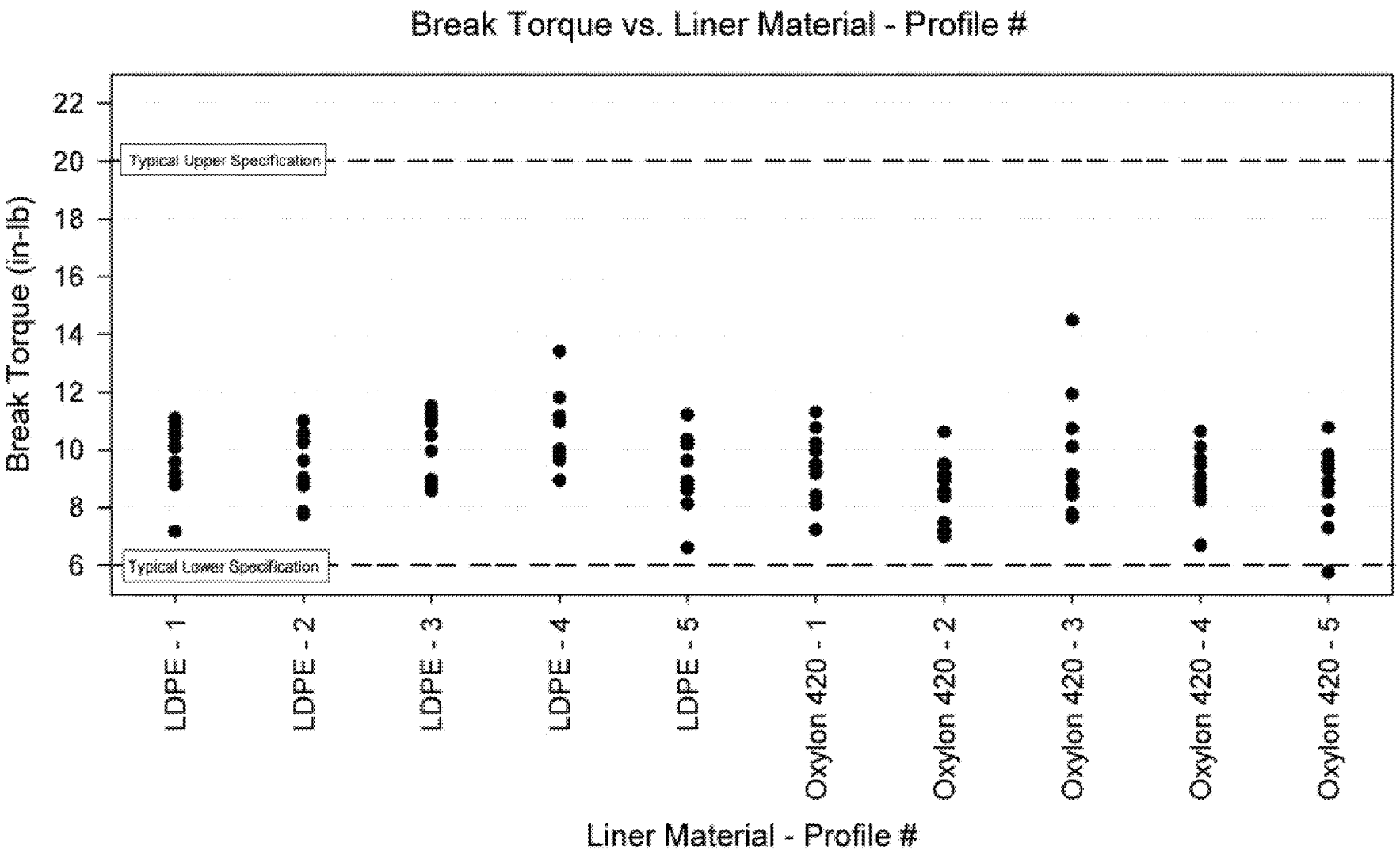
FIG. 23 illustrates an exemplary plot of the effect of various types of cap liners on break torque, according to one embodiment.

Referring to FIG. 23, the break torque scatter plots for cap liners made of an OXYLON® liner material (e.g., Oxylon 420-3, Oxylon 420-4, and Oxylon 420-5) indicate only slight differences when compared with the cap liners made of a LDPE liner material (e.g., LDPE-1, LDPE-2, LDPE-3, LDPE-4, and LDPE-5).

Figure 24:
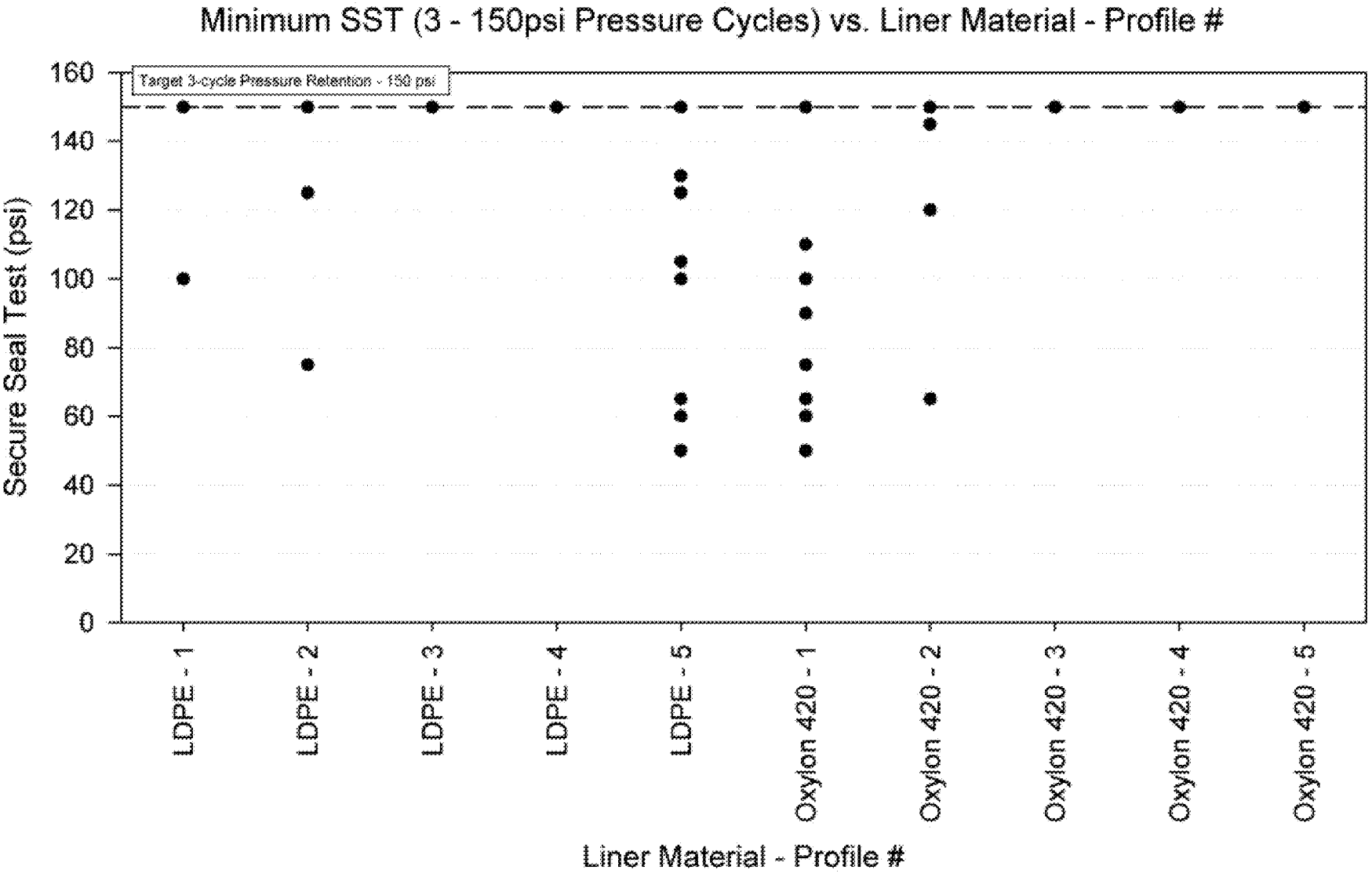
FIG. 24 illustrates an exemplary plot of the effect of various types of cap liners on secure seal test (SST), according to one embodiment.

Further, referring to FIG. 24, the cap liners made of an OXYLON® 420 liner material (Oxylon 420-3, Oxylon 420-4, and Oxylon 420-5) and cap liners made of LDPE (LDPE-3, and LDPE-4) performed well in the SST test by holding the targeted minimum SST of 150 psi for each of 3 pressure cycles. However, the cap liners made of an OXYLON® 420 liner material (Oxylon 420-1, and Oxylon 420-2) and a LDPE liner material (LDPE-1, LDPE-2, and LDPE-5) did not hold pressure well with scatter plots showing a number of the samples leaking below the targeted minimum SST of 150 psi.

Figure 25:
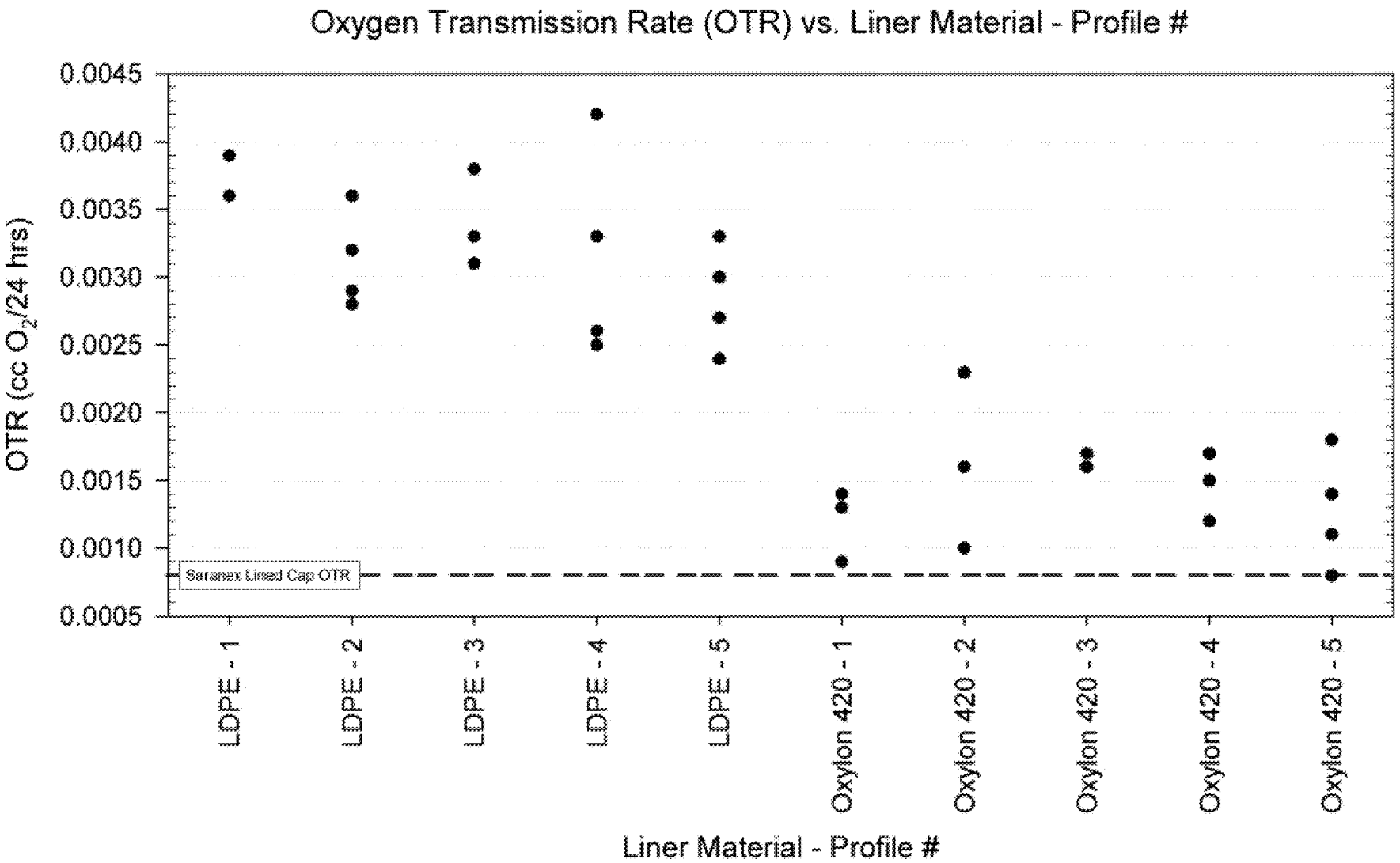
FIG. 25 illustrates an exemplary plot of the effect of various types of cap liners on oxygen transmission rate (OTR), according to one embodiment.

Referring to FIG. 25, the OTR values for the cap liners made of OXYLON® 420 liner material (Oxylon 420-1, Oxylon 420-2, Oxylon 420-3, Oxylon 420-4, and Oxylon 420-5) are lower than the OTR values for the cap liners made of a LDPE liner material (LDPE-1, LDPE-2, LDPE-3, LDPE-4, and LDPE-5). In particular, the OTR for the cap liners made of an OXYLON® 420 liner material is about half of the OTR for the cap liners made of an LDPE liner material.

A cap liner profile is selected based on a targeted slip and a targeted SST. For example, the targeted slip is 6-20 in-lbs., and the targeted SST is a minimum of 150 psi. Referring to FIGS. 22 and 24, the cap liner LDPE-4 provides the best results for a targeted slip of 10-20 in-lbs. and a targeted minimum SST of 150 psi. The cap liner LDPE-3 provides subsequent closest results for the targeted slip and the targeted SST, followed by the cap liner LDPE-2.

FIGS. 26-29 illustrate exemplary plots of slip torque, break torque, SST, and OTR test results for various cap liners respectively, according to one embodiment. In particular, FIGS. 26-29 illustrate plots of slip torque test results, break torque test results, SST test results, and OTR test results respectively for the cap liners LDPE-6, LDPE-7, LDPE-8, Oxylon 907-4 and Oxylon CS25-4.

Figure 26:
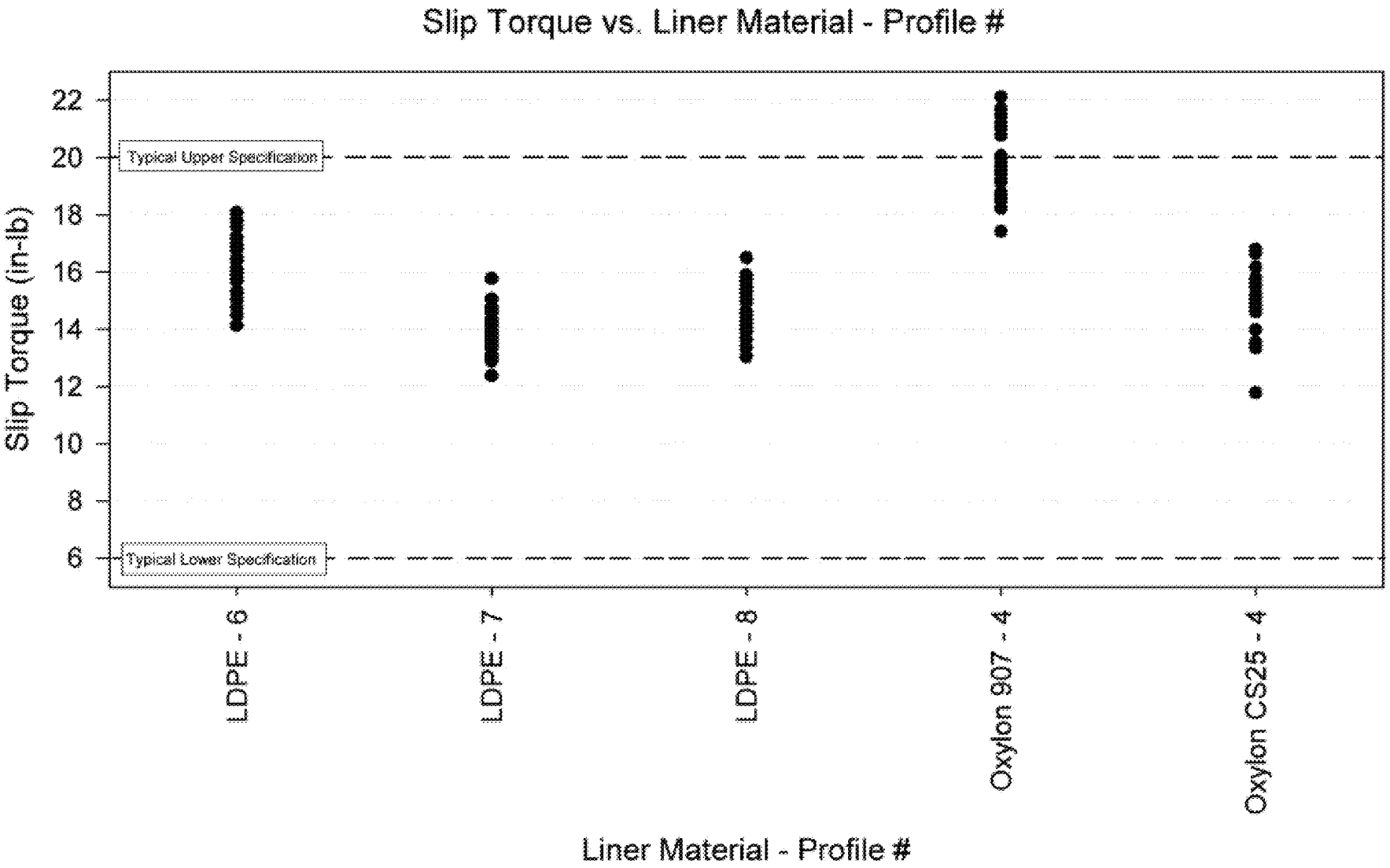
FIG. 26 illustrates another exemplary plot of the effect of various types of cap liners on slip torque, according to one embodiment.
Figure 27:
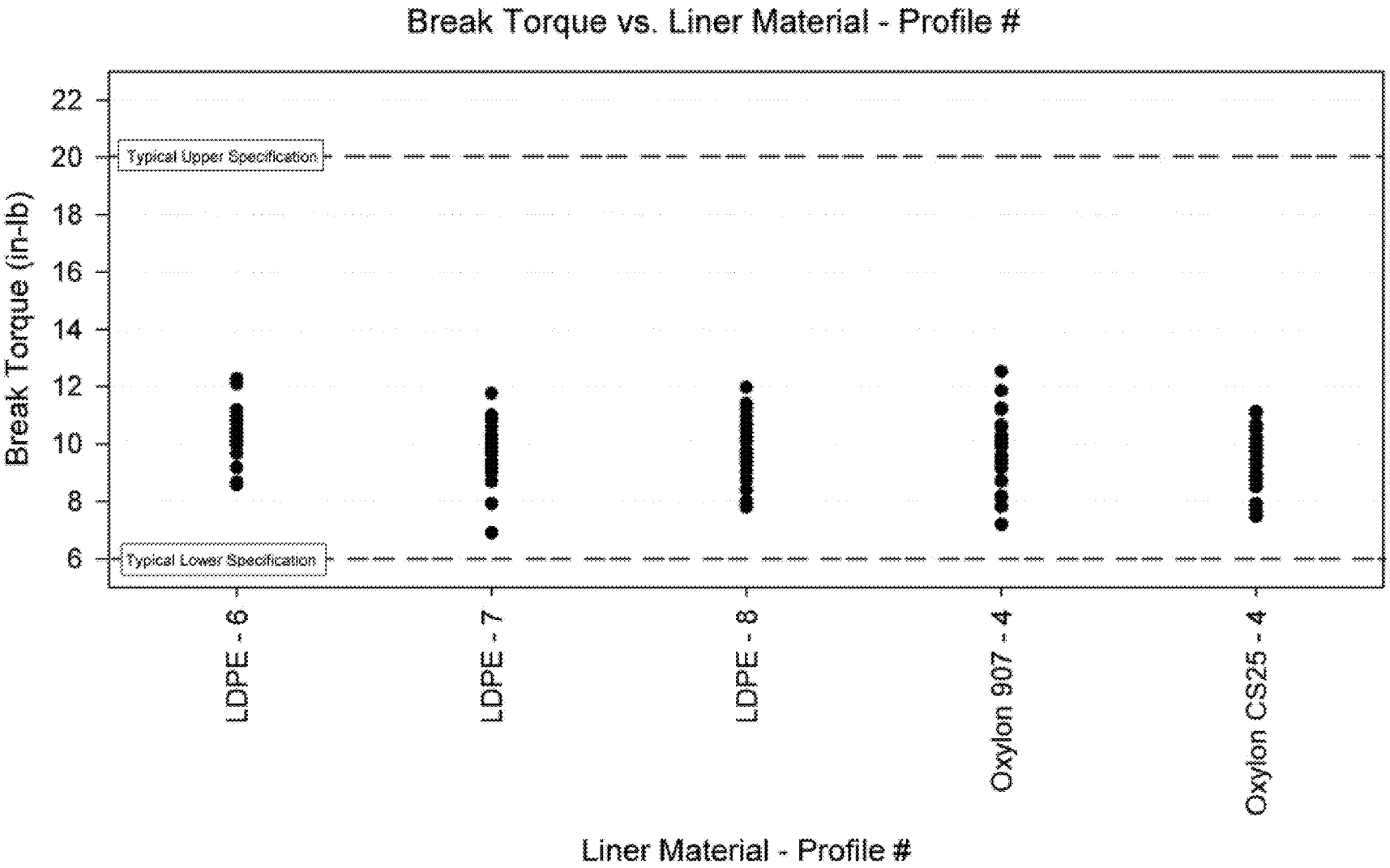
FIG. 27 illustrates another exemplary plot of the effect of various types of cap liners on break torque, according to one embodiment.
Figure 28:
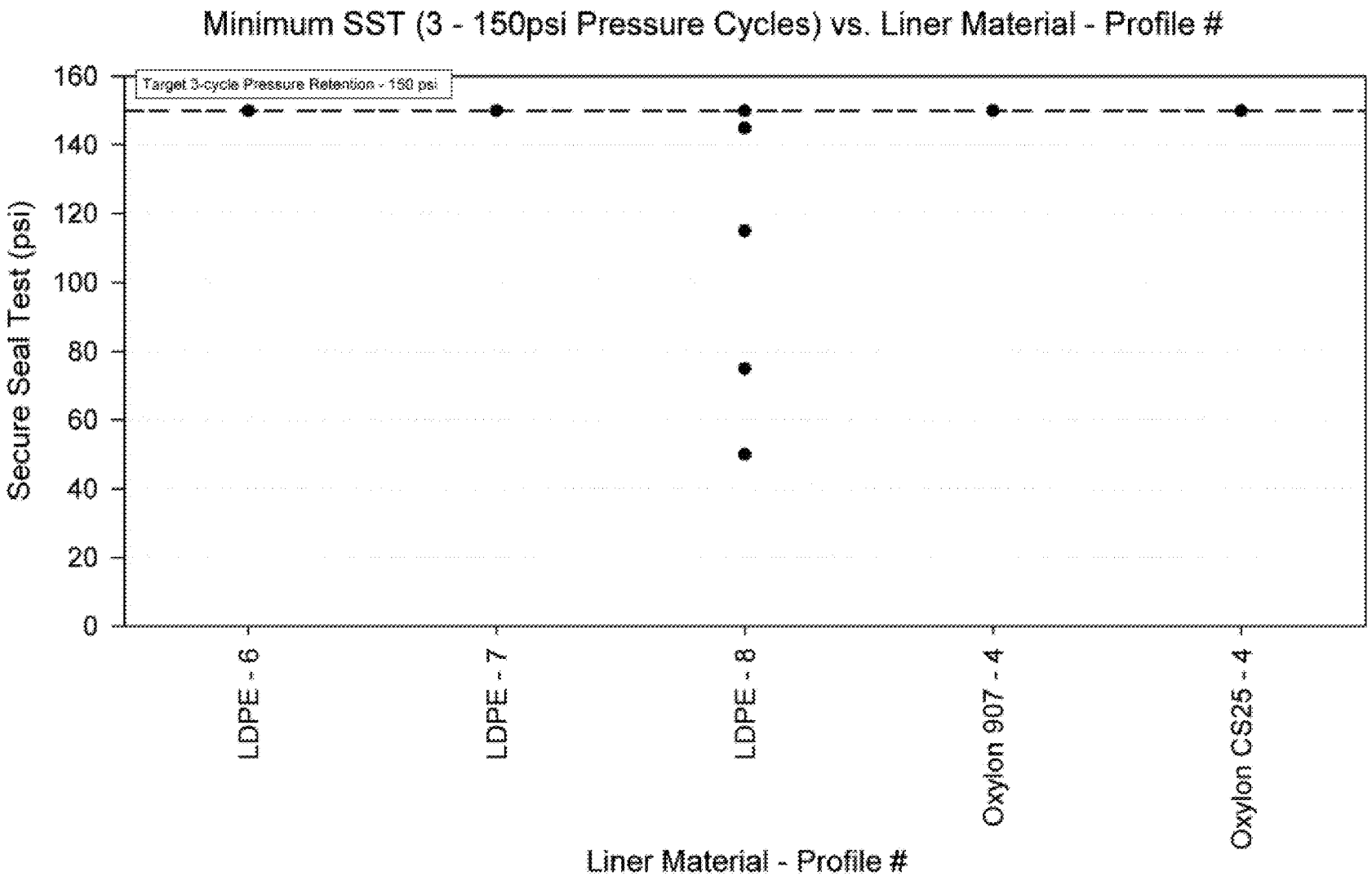
FIG. 28 illustrates another exemplary plot of the effect of various types of cap liners on secure seal test (SST), according to one embodiment.

Referring to FIG. 26 and FIG. 28, the cap liner made of LDPE-7 liner material has a lowest average slip torque of 14.08 in-lbs. and an average SST of 150 psi. According to one embodiment, a slip agent chosen from a number of materials approved for food contact are added to the liner material of a liner profile to reduce slip torque. These slip agents include, but are not limited to, amides, erucamide, oleamide, polyethylene beads, lanolin, and carnauba waxes.

Figure 29:
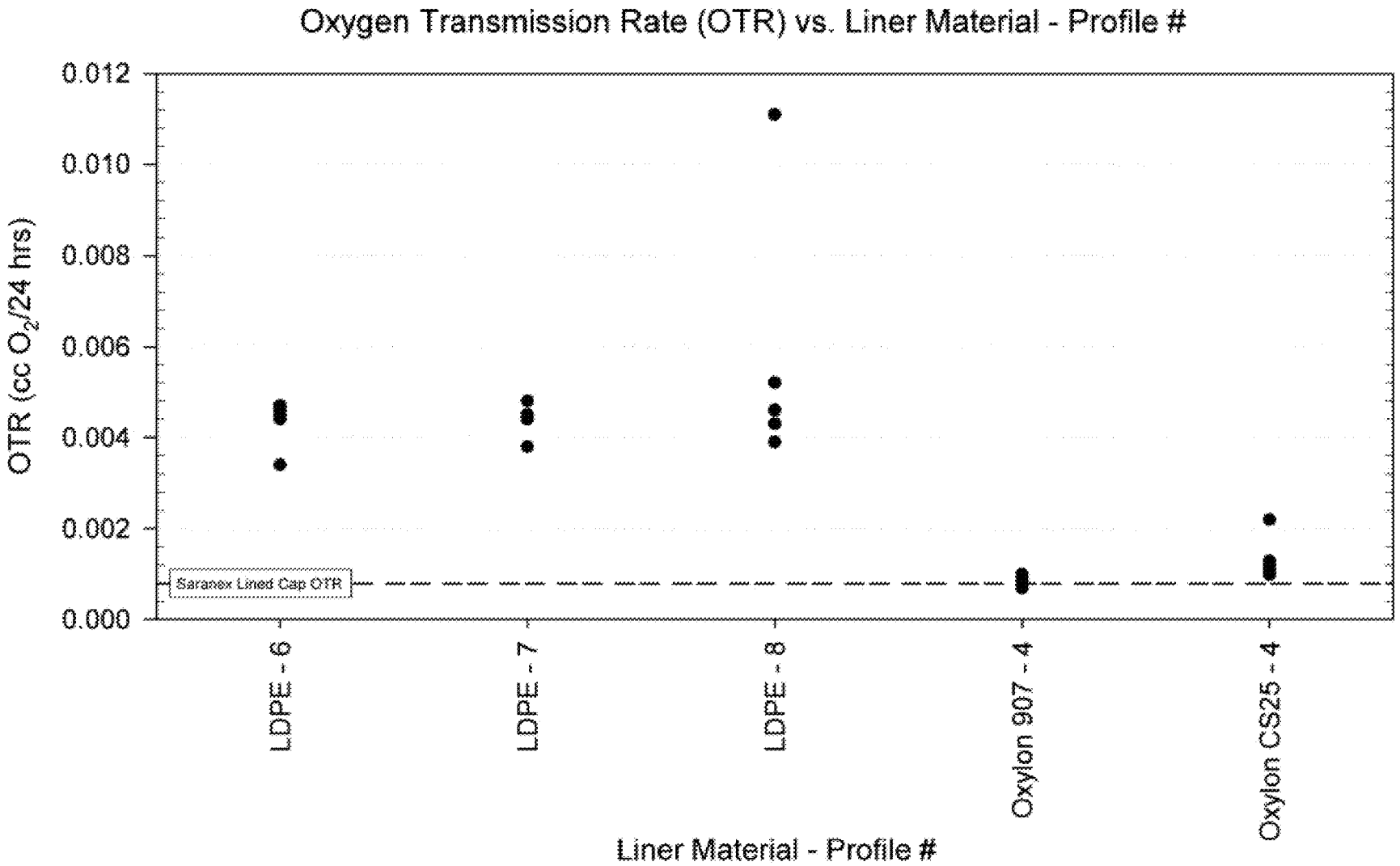
FIG. 29 illustrates another exemplary plot of the effect of various types of cap liners on oxygen transmission rate (OTR), according to one embodiment.

Referring to FIG. 29, the average OTR of the cap liner LDPE-8 is the highest compared to the average OTR of the other cap liners LDPE-6 and LDPE-7. These liners LDPE-6, LDPE-7, LDPE-8 are all made using the same LDPE material and differ only in their physical profile.

Referring to FIG. 26, the cap liner made of using OXYLON® CS25 liner material (Oxylon CS25-4) has a lower average slip than the cap liner made of an OXYLON® 907 liner material (Oxylon 907-4). However, both Oxylon CS25-4 and Oxylon 907-4 have the same average SST of 150 psi, as illustrated in FIG. 28. Oxylon 907-4 has a lower OTR than Oxylon CS25-4, as illustrated in FIG. 29. These liners Oxylon 907-4, Oxylon CS25-4 are made using the same physical profile and differ only in the TPE materials.

FIGS. 30-33 illustrate exemplary plots of slip torque, break torque, SST, and OTR test results for various cap liners respectively, according to one embodiment. In particular, FIGS. 30-33 illustrate plots of slip torque test results, break torque test results, SST test results, and OTR test results respectively for the cap liners made of, LDPE used for the exemplary embodiments of FIGS. 9(*a*)-9(*c*), LDPE-OL1, LDPE-OL2, LDPE-OL3, LDPE-OL4, LDPE-OL5, LDPE-OL6 and LDPE-OL7.

According to one embodiment, a slip agent chosen from a number of materials approved for food contact are added to the liner material of a liner profile to reduce slip torque. These slip agents include, but are not limited to, amides, erucamide, oleamide, polyethylene beads, lanolin, and carnauba waxes.

Figure 30:
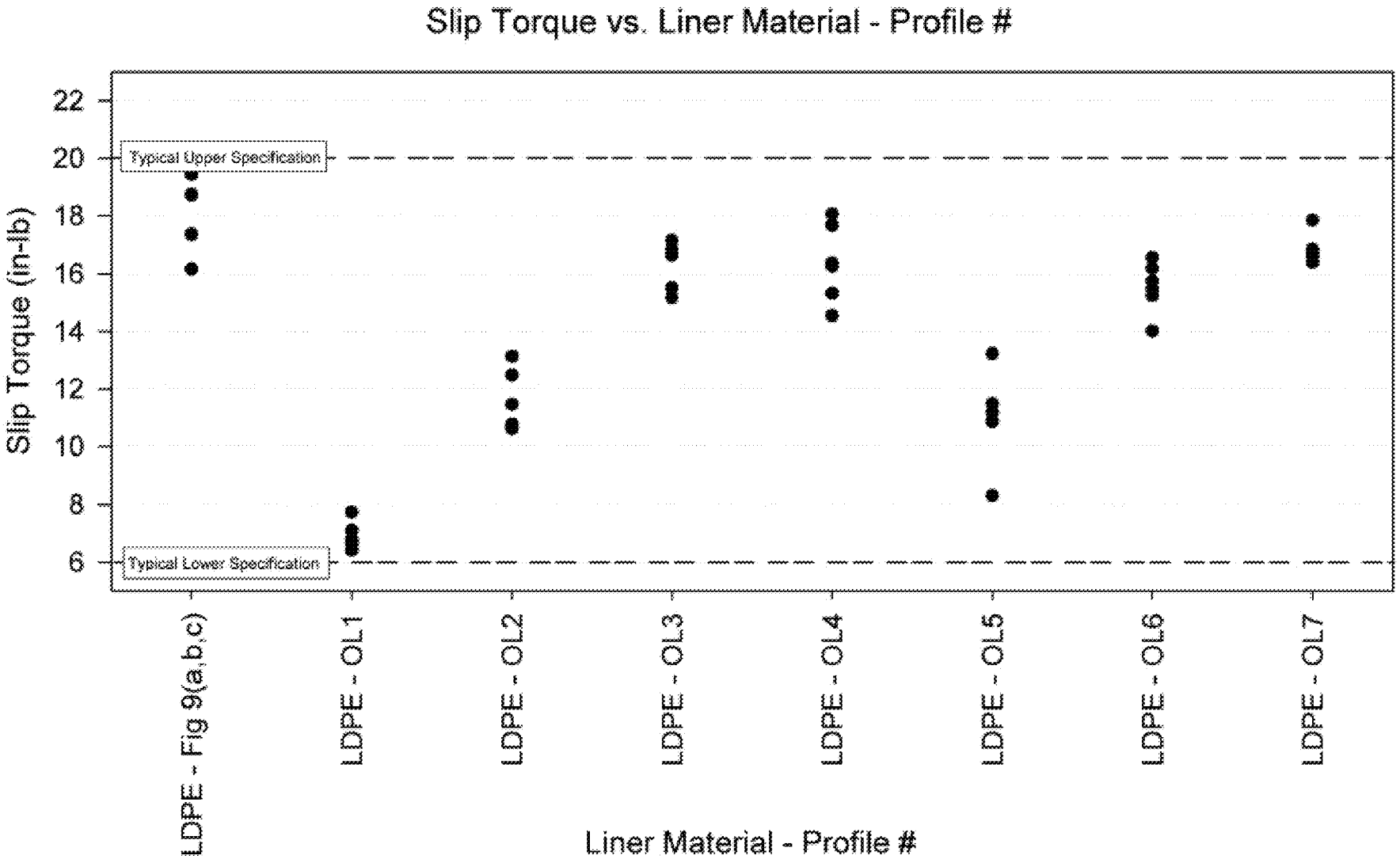
FIG. 30 illustrates another exemplary plot of the effect of various types of cap liners on slip torque, according to one embodiment.
Figure 31:
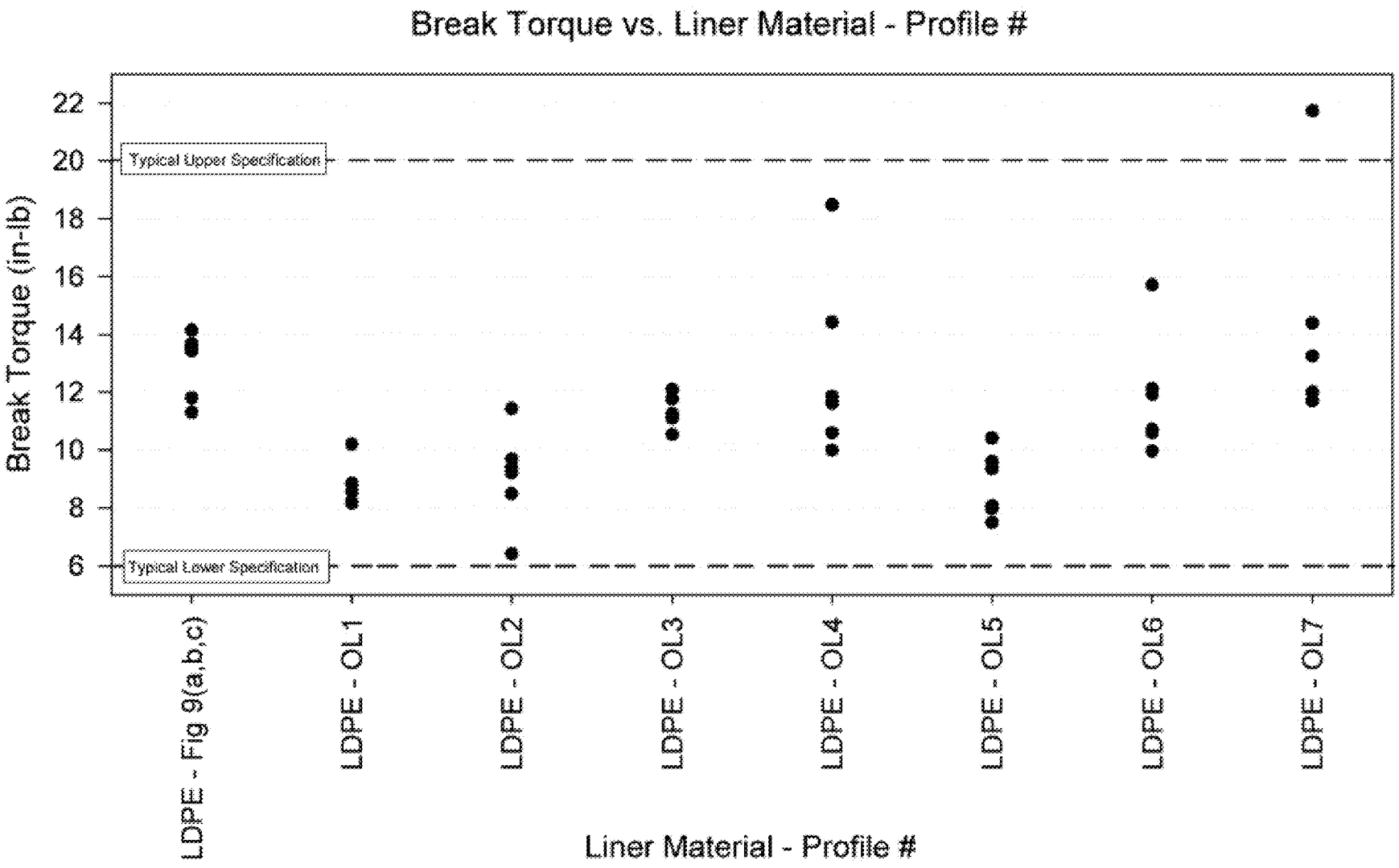
FIG. 31 illustrates another exemplary plot of the effect of various types of cap liners on break torque, according to one embodiment.
Figure 32:
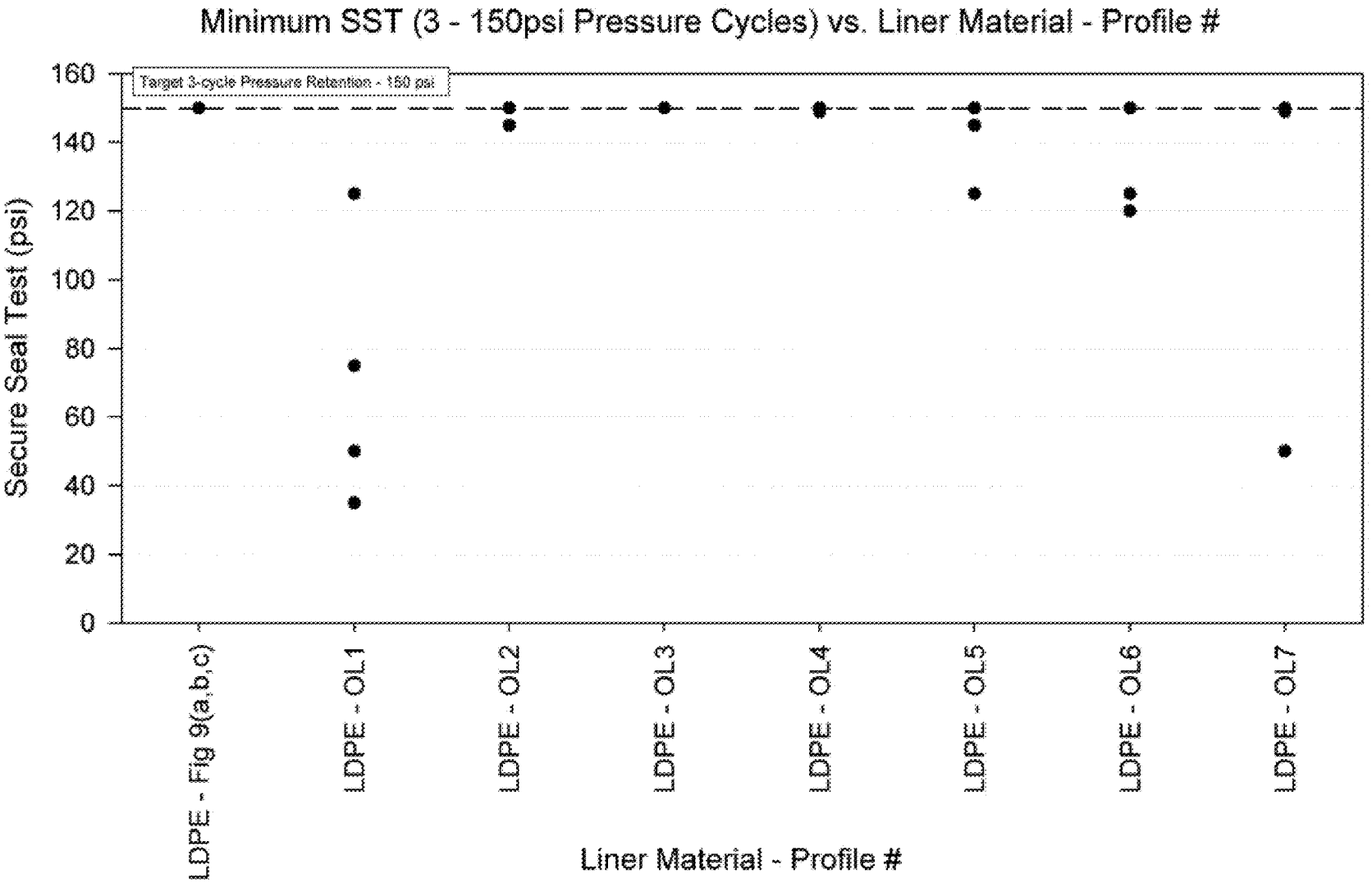
FIG. 32 illustrates another exemplary plot of the effect of various types of cap liners on secure seal test (SST), according to one embodiment.
Figure 33:
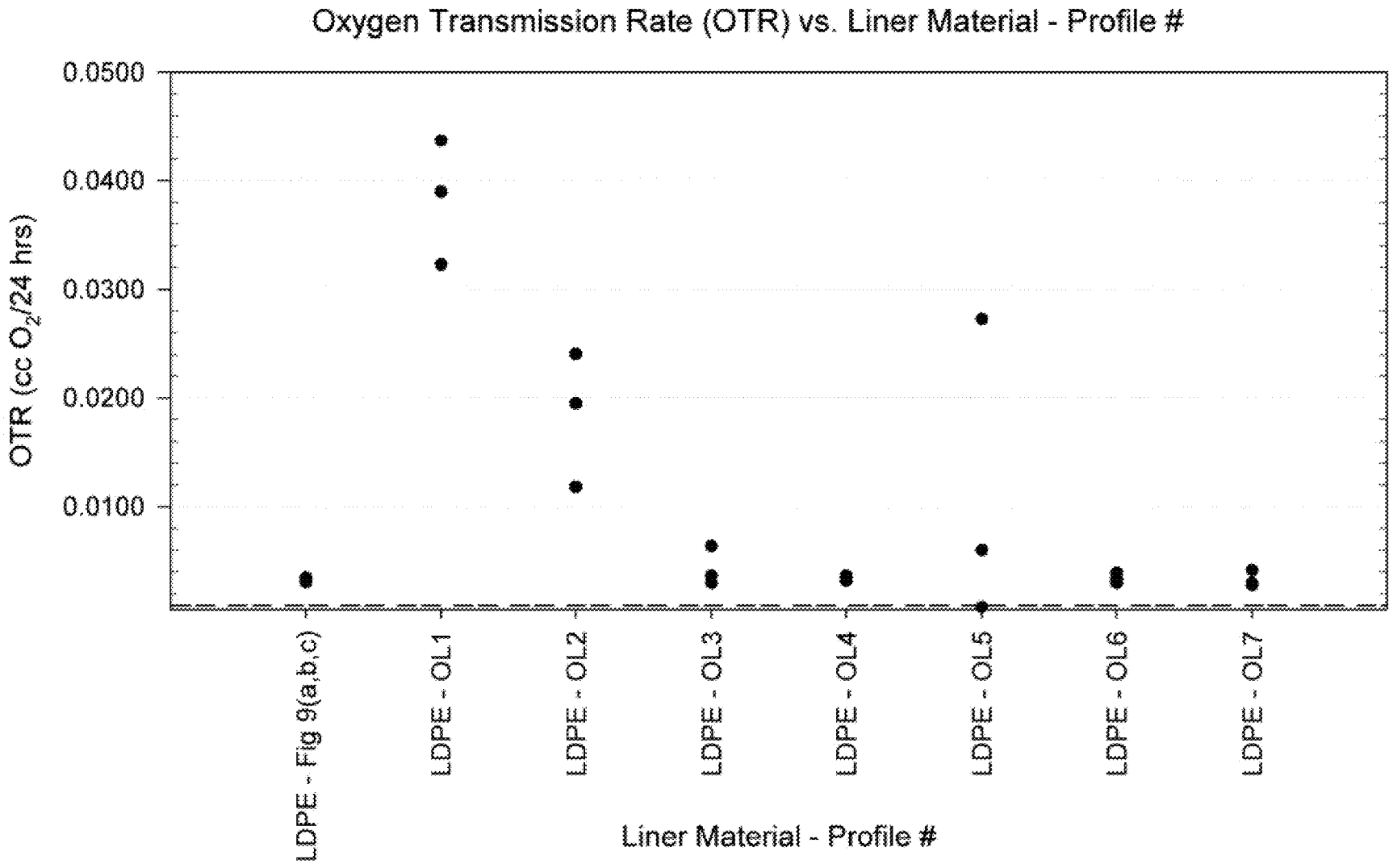
FIG. 33 illustrates another exemplary plot of the effect of various types of cap liners on oxygen transmission rate (OTR), according to one embodiment.

Referring to FIG. 30, the cap liner made of LDPE-OL1 liner material has a lowest average slip torque of approximately 7 in-lbs. However, referring to FIG. 32, the cap liners having specific profiles LDPE-FIG. 9(*a*)(*b*)(*c*) and LDPE-OL3 all held an average SST pressure of 150 psi. Referring to FIG. 33, the average OTR of the cap liner LDPE-OL1 is the highest compared to the average OTR of the other cap liners LDPE-FIG. 9(*a*)(*b*)(*c*), LDPE-OL2, LDPE-OL3, LDPE-OL4, LDPE-OL5, LDPE-OL6 and LDPE-OL7. All liners LDPE-FIG. 9(*a*)(*b*)(*c*), LDPE-OL1, LDPE-OL2, LDPE-OL3, LDPE-OL4, LDPE-OL5, LDPE-OL6 and LDPE-OL7 were made using the same LDPE material and differed only in their physical profiles.

According to one embodiment, each cap liner sample is manually inserted into a 30×60 mm aluminum screw cap and applied to a wine bottle. (U.S. standard-GPI finish 1680). The wine bottle may contain any type of liquid, such as water or lightly carbonated wine. In one embodiment, each wine bottle is pressurized to a desired level to a mimic a desired carbon dioxide level (e.g., 2-4 g $CO_2$/L) within the wine bottle. Each cap closure may be applied to a desired bottle finish using any capper equipment known in the art.

According to one embodiment, the capper settings used to apply each cap closure containing each liner Oxylon 420-1, Oxylon 420-2, Oxylon 420-3, Oxylon 420-4, Oxylon 420-5, LDPE-1, LDPE-2, LDPE-3, LDPE-4, LDPE-5 are: a top-load of 450 lbf; a reform depth of 0.070 inches; a thread roller force of 28 lbf; a pilfer roller force of 20 lbf; thread and pilfer roller heights are set to proper gage.

According to another embodiment, the capper setting used to apply each cap closure containing each liner profile Oxylon 907-4, Oxylon CS25-4, LDPE-6, LDPE-7, LDPE-8, are: a top load of 400 lbf; a reform depth of 0.074 inches, a thread roller force of 28 lbf; a pilfer roller force of 25 lbf; and roller heights are set to proper gage.

Figure 34:
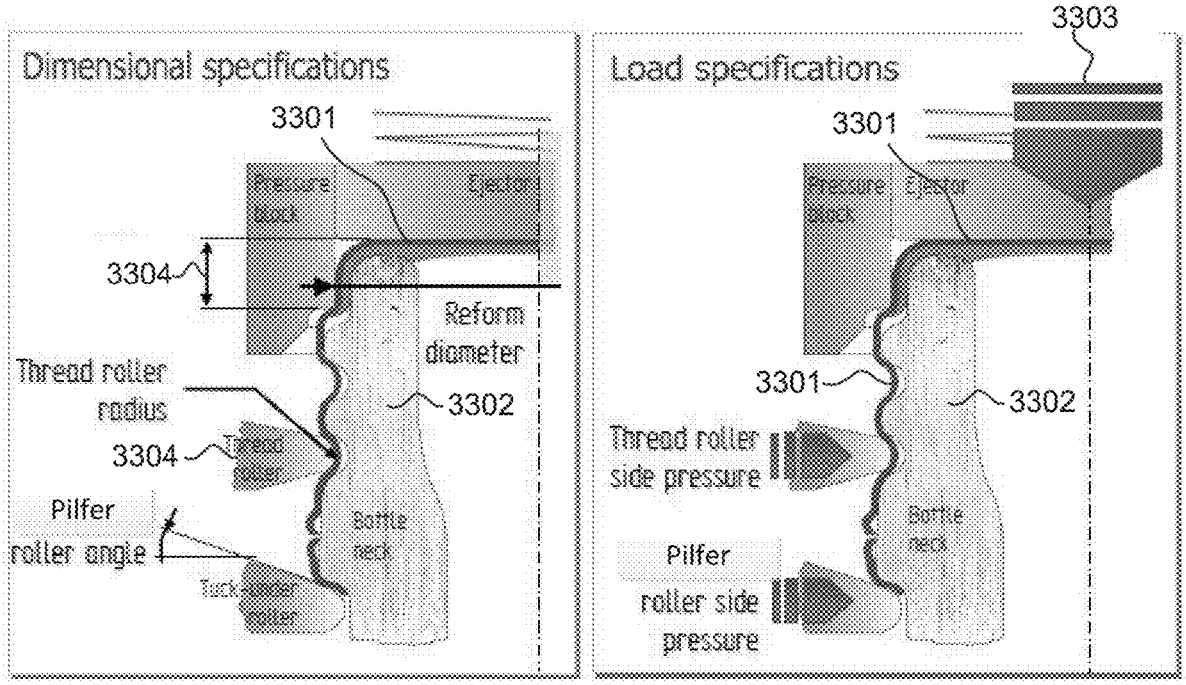
FIG. 34 illustrates an exemplary diagram of capper settings that are adjusted for the proper application of a cap closure to a bottle, according to one embodiment.

FIG. 34 illustrates an exemplary diagram of capper settings used to apply a cap closure to a bottle, according to one embodiment. A top load 3303 refers to an amount of force that is applied to the top of a cap metal 3301 to compress the cap liner within the cap metal 3301 onto a bottle's sealing surface 3302. A reform depth 3304 refers to a depth that the cap metal 3301 is forced tight over the bottle's seal surface 3302. A thread roller 3304 pushes on a side of the cap metal 3301 to apply a thread roller force which forms threads in the cap metal 3301 during application.

According to one embodiment, the cap liner samples are allowed to sit for a minimum of 24 hours prior to testing. Each cap liner sample is evaluated for pressure retention using a SECUREPAK® (a type of package testing instrument) Secure Seal Tester by pressurizing each sample's headspace to 150 psi, holding the pressure of each sample at 150 psi for 5-10 seconds and then releasing the pressure to 0 psi. This pressurization is repeated three times for each sample, with the maximum pressure (psi) held being recorded. In another embodiment, each cap liner sample is evaluated for oxygen transmission rate (OTR) to determine the rate at which oxygen permeates through each cap liner. The cap liner samples are allowed to equilibrate for a minimum of three days on an equilibration rack, transferred to the MOCON® OX-TRAN® 2121 testing stations and tested a minimum of three times or until the steady-state OTR is reached.

Competitive cap products (ERBEN® ASTRO and GUALA® MOSS) contain injection molded liners with inner ribs. Competitors claim this inner rib helps the package retain pressure generated by the carbonated beverage. In particular, the ERBEN® ASTRO liner is patented in Italy by Strocco et al. (Patent No. 0001378221 entitled "Plastic Gasket with a Pressure Seal for Closing Bottles or Similar Contains") and contains references to the inner rib as being integral to the liner's sealing characteristics. However, the results of the present DOE modeling illustrates that the present liner profile does not require an inner rib to increase the ability of the liner to seal. In particular, the present liner profile does not include an inner rib since the sealing performance of the liner is based on configuration of the outer lip and the material used to create the outer lip.

According to one embodiment, the present cap liner profiles are injection molded, single-layered liners made from either an LDPE liner material or a TPE liner material that provides superior oxygen barrier properties. The TPE liner material may include, but not limited to, OXYLON® 420, OXYLON® 907, and OXYLON® CS25 manufactured by ACTEGA® (a company that manufactures coatings and sealants).

According to another embodiment, the present cap liner profiles are dual-injection molded, double-layered liners made from an LDPE liner material and a TPE liner material that provides superior oxygen barrier properties. The TPE liner material may include, but not limited to, OXYLON® 420, OXYLON® 907, and OXYLON® CS25 manufactured by ACTEGA® (a company that manufactures coatings and sealants).

FIGS. 35-36 illustrate exemplary physical and chemical properties of OXYLON® 420 liner material, according to one embodiment. FIGS. 37-38 illustrate exemplary physical and chemical properties of OXYLON® 907 liner material, according to one embodiment. FIGS. 39-40 illustrate exemplary physical and chemical properties of OXYLON® CS25 liner material, according to one embodiment.

The above example embodiments have been described hereinabove to illustrate various embodiments of providing a system and method for implementing cap closure for carbonated wine. Various modifications and departures from the disclosed example embodiments will occur to those having ordinary skill in the art. The subject matter that is intended to be within the scope of the disclosure is set forth in the following claims.

We claim:

1. An apparatus, comprising:

a cap liner having a circular ring shape with an outer lip and an inner portion, wherein the outer lip is taller than the inner portion, and the inner portion is planar;

wherein the inner portion is made of a solid material that extends to a center of the cap liner from the outer lip;

wherein the cap liner has an upper side and a lower side, and the cap liner has a first circular shaped cavity and a second circular shaped cavity;

wherein the first circular shaped cavity is depressed into the upper side of the cap liner and the second circular shaped cavity is depressed into the lower side of the cap liner; and wherein the upper side and the lower side of the cap liner are symmetrical about a horizontal axis between them.

2. The apparatus of claim 1, wherein the outer lip has a first structure that extends substantially upward from a top surface of the inner portion, a second structure that extends substantially downward from a bottom surface of the inner portion, and the first structure and the second structure are symmetrically shaped.

3. The apparatus of claim 2, wherein the first structure and the second structure are angled toward the center.

4. The apparatus of claim 2, wherein the first structure and the second structure are angled away from the center.

5. The apparatus of claim 2, wherein one or more of the outer lip, the inner portion, and the first structure and the second structure are dual injection molded.

6. The apparatus of claim 2, wherein one or more of the outer lip, the inner portion, and the first structure and the second structure are made of low-density polyethylene (LDPE).

7. The apparatus of claim 2, wherein one or more of the outer lip, the inner portion, and the first structure and the second structure are made of thermoplastic elastomer (TPE).

8. The apparatus of claim 2, wherein one or more of the outer lip, the inner portion, and the first structure and the second structure are injection molded.

9. The apparatus of claim 2, wherein one or more of the outer lip, the inner portion, and the first structure and the second structure are over-molded.

10. The apparatus of claim 1, further comprising a slip agent.

11. The apparatus of claim 10, wherein the slip agent is one or more of amides, erucamide, oleamide, polyethylene beads, lanolin, and carnauba waxes.

12. The apparatus of claim 2, wherein at least one of the first structure and the second structure is ring shaped.

13. The apparatus of claim 2, wherein at least one of the first structure and the second structure is a tab.

14. The apparatus of claim 1, further comprising the cap.

15. The apparatus of claim 1, wherein the cap liner is configured to fit inside a cap.

16. The apparatus of claim 1, wherein the cap liner controls a transmission rate of oxygen into a beverage container.

17. The apparatus of claim 1, wherein the cap liner has a friction factor that allows a cap of a beverage container to be opened using human force.

18. The apparatus of claim 1, wherein the cap liner maintains pressure within a beverage container having a carbonated beverage.

* * * * *